US010823430B2

(12) United States Patent
Könneker et al.

(10) Patent No.: US 10,823,430 B2
(45) Date of Patent: Nov. 3, 2020

(54) DEVICE FOR EXTRACTING COOKING VAPORS

(71) Applicant: Wilhelm Bruckbauer, Neubeuern (DE)

(72) Inventors: Walter Könneker, Rosenheim (DE); Mario Blersch, Brannenburg (DE)

(73) Assignee: Wilhelm Bruckbauer, Neubeuern (DE)

( * ) Notice: Subject to any disclaimer, the term of this patent is extended or adjusted under 35 U.S.C. 154(b) by 88 days.

(21) Appl. No.: 16/312,700

(22) PCT Filed: Jun. 22, 2017

(86) PCT No.: PCT/EP2017/065344
§ 371 (c)(1),
(2) Date: Dec. 21, 2018

(87) PCT Pub. No.: WO2017/220707
PCT Pub. Date: Dec. 28, 2017

(65) Prior Publication Data

US 2019/0212016 A1 Jul. 11, 2019

(30) Foreign Application Priority Data

Jun. 22, 2016 (DE) ..... 10 2016 211 207

(51) Int. Cl.
*F24C 15/20* (2006.01)

(52) U.S. Cl.
CPC ..... *F24C 15/2042* (2013.01)

(58) Field of Classification Search
None
See application file for complete search history.

(56) References Cited

U.S. PATENT DOCUMENTS

| | | | | |
|---|---|---|---|---|
| 4,962,694 | A | 10/1990 | Graver | |
| 5,394,861 | A * | 3/1995 | Stegmaier | F24C 15/20 126/299 D |
| 6,584,968 | B1 * | 7/2003 | Morton | F24C 15/2021 126/299 D |
| 8,851,064 | B2 * | 10/2014 | Bruckbauer | F24C 15/2042 126/299 D |
| 9,702,565 | B2 * | 7/2017 | Livchak | F24C 15/2042 |
| 9,719,686 | B2 * | 8/2017 | Livchak | F24C 15/2021 |
| 10,006,641 | B2 | 6/2018 | Bruckbauer | |
| 10,072,849 | B2 * | 9/2018 | Kim | H05B 3/68 |
| 10,337,744 | B2 * | 7/2019 | Kitaura | F24C 7/006 |
| 10,473,336 | B2 * | 11/2019 | Livchak | B01D 53/72 |
| 2012/0309287 | A1 * | 12/2012 | Zimmer | F24F 13/12 454/367 |
| 2014/0048057 | A1 * | 2/2014 | Bruckbauer | F24C 15/2042 126/299 D |
| 2015/0211747 | A1 * | 7/2015 | Hildner | F24C 15/2007 126/21 R |

(Continued)

FOREIGN PATENT DOCUMENTS

| | | | |
|---|---|---|---|
| CN | 201680496 | U | 12/2010 |
| CN | 103375835 | A | 10/2013 |

(Continued)

*Primary Examiner* — David J Laux
(74) *Attorney, Agent, or Firm* — McGlew and Tuttle, P.C.

(57) ABSTRACT

A device for extracting cooking vapors includes a repositionable closure element which in the repositioning between two terminal positions has at least one rotary movement component and at least one linear movement component.

11 Claims, 27 Drawing Sheets

(56) References Cited

U.S. PATENT DOCUMENTS

| | | | | |
|---|---|---|---|---|
| 2016/0231019 | A1* | 8/2016 | Rousseau | F24F 13/1413 |
| 2018/0335217 | A1 | 11/2018 | Bruckbauer | |
| 2020/0182484 | A1* | 6/2020 | Cowan | F23N 3/085 |

FOREIGN PATENT DOCUMENTS

| | | | |
|---|---|---|---|
| CN | 103688111 | A | 3/2014 |
| DE | 27 00 332 | A1 | 7/1977 |
| DE | 10 2007 002 241 | A1 | 7/2008 |
| DE | 20 2009 008 286 | U1 | 9/2009 |
| DE | 20 2011 005698 | U1 | 9/2011 |
| DE | 20 2012 001839 | U1 | 4/2012 |
| DE | 10 2012 207 850 | A1 | 11/2013 |
| DE | 20 2013 010 646 | U1 | 2/2014 |
| DE | 10 2013 220 285 | A1 | 4/2014 |
| DE | 10 2013 007722 | A1 | 11/2014 |
| DE | 10 2015 213 470 | A1 | 1/2017 |
| DE | 10 2015 213 471 | A1 | 1/2017 |
| EP | 2 653 787 | A2 | 10/2013 |
| EP | 2 702 329 | B1 | 7/2015 |
| WO | 2012/146 237 | A1 | 11/2012 |

* cited by examiner

DEVICE FOR EXTRACTING COOKING VAPORS

CROSS REFERENCE TO RELATED APPLICATIONS

This application is a United States National Phase Application of International Application PCT/EP2017/065344 filed Jun. 22, 2017 and claims the benefit of priority under 35 U.S.C. § 119 of German patent application Serial No. DE 10 2016 211 207.4 filed Jun. 22, 2016, the entire contents of which are incorporated herein by reference.

FIELD OF THE INVENTION

The invention relates to a device for extracting cooking vapors. The invention moreover relates to a hob system having a device of this type. The invention finally relates to an item of kitchen furniture having a respective device.

BACKGROUND OF THE INVENTION

A device for extracting cooking vapors is known, for example, from DE 10 2007 002 241 A1. A hob system having a device for suctioning cooking vapors is known, for example, from WO 2012/146 237 A1.

There is an ongoing requirement for devices of this type for extracting cooking vapors and for hob systems of this type to be improved.

SUMMARY OF THE INVENTION

This object is achieved by a device for extracting cooking vapors, comprising a cooking vapors entry installation having a cooking vapors entry opening which is closable by means of at least one closure element, and an activation installation for activating the at least one closure element, wherein the activation installation is configured in such a manner that the at least one closure element by means of the activation installation is repositionable between a first position that closes the cooking vapors entry opening, and a second position that unblocks the cooking vapors entry opening, wherein the at least one closure element in the repositioning between the two positions has at least one rotary movement component and at least one linear movement component, and wherein the activation installation has a purely rotary drive by means of which the at least one closure element is repositionable. Furthermore, this object is achieved by a hob having a device of this type, respectively.

The core concept of the invention lies in providing a closure element for closing a cooking vapors entry opening, said closure element being repositionable by means of an activation installation, wherein the closure element in the repositioning between two terminal positions has at least one rotary movement component and at least one linear movement component. The closure element is in particular repositionable between two defined terminal positions, which are also referred to as end positions. The closure element in the first terminal position closes the cooking vapors entry opening. Said closure element in the second terminal position unblocks the cooking vapors entry opening.

According to one aspect of the invention the activation installation for activating the closure element is configured in such a manner that the at least one closure element in the repositioning between the two terminal positions has at least one rotary movement component and at least one linear movement component. The respective movements can be provided so as to be at least in part mutually sequential. In particular, two linear movement components and one rotary movement component can be provided. For example, it is possible for the activation installation to be configured in such a manner that the at least one closure element in the repositioning between the two terminal positions first performs a linear, in particular a purely linear, movement, thereafter a rotary, in particular a purely rotary, movement, and subsequently once again a linear, in particular a purely linear, movement. The two linear movement components herein are preferably linear independent. Said two linear movement components can in particular be aligned so as to be mutually perpendicular. Said two linear movement components can in particular be aligned so as to be in each case parallel with a plane normal on the closure element in the respective terminal positions.

It is thus in particular possible for the closure element for repositioning, proceeding from one of the terminal positions, to be displaced initially in a linear manner to the respective other terminal position, thereafter to be pivoted, and finally to be once again displaced in a linear manner.

The pivoting of the closure element is performed in particular about a pivot axis which is aligned so as to be parallel with the longitudinal direction of the closure element in one or both of the terminal positions.

The closure of the cooking vapors entry opening in the first terminal position, on the one hand, and the disposal of the closure element in the second terminal position, on the other hand, can be improved by way of the repositioning of the closure element by way of at least one rotary movement component and at least one linear motor component. The properties of the device in terms of fluid mechanics can be improved in particular.

The cooking vapors entry installation, in particular the cooking vapors entry opening, remains stationary in the operation of the device, in particular in the repositioning of the closure element. This leads to a simpler construction of the device. Moreover, it can be avoided on account thereof that component parts of the extractor device in the operation of the latter project beyond a hob plane. A vertical repositioning of the cooking vapors entry opening can be avoided in particular.

The closure element can be configured as a closure flap, in particular as a single-part or multiple-part closure flap. In the case of a configuration in multiple parts, the closure element can be subdivided into a plurality of part-regions in the longitudinal direction and/or in the transverse direction. The part-regions can be repositionable individually, that is to say in a mutually separate manner.

The closure element can be configured so as to be plate-shaped, in particular so as to have a planar surface. Said closure element can also have a bent or curved surface, respectively.

The extractor device serves in particular for extracting cooking vapors in a downward manner, in particular in the direction below a plane that is defined by the cooking vapors entry opening. The extractor device is also referred to as a downdraft ventilator or a downdraft system (system for downward extraction).

According to one aspect of the invention the activation installation for activating the closure element is configured in such a manner that the at least one closure element in the repositioning between the two terminal positions has at least movement components that are linearly independent.

A rotary movement herein in linear terms is to be referred to as being independent of a linear movement as long as the alignment of the rotation axis is not aligned so as to be parallel with the direction of the linear movement.

Alternative combinations of movement components that in linear terms are independent are likewise possible. It is in particular possible for the closure element in the repositioning between the two terminal positions to have more than a single rotary movement component. Said closure element can in particular have two or more rotary movement components having dissimilar pivot axes.

The closure element can be repositioned between the two terminal positions in a tight space by way of a combination of the dissimilar movement components.

According to one further aspect of the invention, the closure element for repositioning is guided by means of at least one guide in the form of a slotted link. On account thereof, it is possible for a multi-component repositionability of the closure element to be achieved in a relatively simple manner.

The guide in the form of the slotted link comprises in particular a curved guide slot. A guide slide block is mounted so as to be guided in the guide slot. The guide slide block moreover engages in an opening of a force transmission lever. The opening can be configured as an elongate hole. At the opposite end of the lever the latter is connected to a rotary drive.

The guide slide block is fixedly connected to the closure element.

The guide slot is disposed so as to be locationally fixed in relation to the cooking vapors entry installation.

The guide slot can be configured so as to be substantially quadrant-shaped. The guide slot herein can be tangentially extended at at least one end, in particular at both ends. The guide slot thus has in particular at least one straight portion and one curved, in particular arcuate, region. The guide slot can in particular have two straight regions and an intervening arcuate region.

A further guide slot can moreover be provided. Said further guide slot can be disposed so as to be locationally fixed in relation to the closure element. Said further guide slot is in particular configured so as to be straight. A guide slide block that is connected in a locationally fixed manner to the cooking vapors entry installation is mounted so as to be guided in said guide slot.

According to one further aspect of the invention the activation installation has a purely rotary drive by means of which the at least one closure element is repositionable. A motor, in particular an electric motor, serves as the drive. A plurality of drive motors can also be provided. One or a plurality of actuators or server motors can be provided in particular as the drive. This enables a uniform motion sequence for the repositioning of the closure element.

According to one further aspect of the invention the closure element both in the first as well as in the second terminal position lies below an upper boundary of the cooking vapors entry installation. Said closure element lies in particular completely below the upper boundary of the cooking vapors entry installation. Said closure element, in particular in the case of a bulged configuration, can also project somewhat, in particular by a few millimeters, beyond the upper boundary of the cooking vapors entry installation. Said closure element, in particular in the first position that closes the cooking vapors entry opening, can lead to the peripheral region of the cooking vapors entry installation that is interrupted by the cooking vapors entry opening being complemented or continued, respectively.

The closure element can in particular be configured in such a manner that said closure element in the first position that closes the cooking vapors entry opening forms a continuation of a peripheral region of the cooking vapors entry installation that surrounds the cooking vapors entry opening, said continuation being capable of being described by a continuous, in particular a differentiable, in particular a continuously differentiable function.

According to one further aspect of the invention the cooking vapors entry opening is closable in a tight manner by means of the at least one closure element. Said cooking vapors entry opening is closable in particular in a liquid-tight manner. Said cooking vapors entry opening can also be closable in a gas-tight manner.

On account thereof, any unintended ingress of liquids into the cooking vapors entry installation, in particular in the switched-off state of the extractor device, can be avoided in particular. On account thereof, it can moreover be avoided that odors from below the cooking vapors entry opening can exit by way of said cooking vapors entry opening in the closed state of the latter.

In order for the tightness to be improved, sealing elements can be disposed in the peripheral region of the cooking vapors entry opening and/or of the closure element. The sealing element can in particular be disposed so as to encircle the cooking vapors entry opening and/or the closure element.

According to one further aspect of the invention the at least one closure element in the second position thereof that unblocks the cooking vapors entry opening is disposed completely outside a flow region of the cooking vapors. The at least one closure element, in particular in the second position thereof that unblocks the cooking vapors entry opening, can in each case be disposed completely outside the flow region The cylindrical region having the template defined by the cooking vapors entry opening and a generated function that runs perpendicular to said template is referred to in particular as the flow region. The generated function can also be aligned so as to be oblique to the cooking vapors entry opening. Said generated function in relation to the cooking vapors entry opening can in particular enclose an angle in the range from 60° to 120°, in particular in the range from 75° to 105°. Said generated function can in particular be inclined by at least 5°, in particular at least 10°, to the vertical. This can be advantageous in particular in the case of an oblique configuration of the cooking vapors entry installation, or of an extractor duct that adjoins the cooking vapors entry opening, respectively, or of an obliquely running extractor duct region, respectively.

On account of disposal of the closure element outside the flow region it can be achieved that the closure element in the second position thereof that unblocks the cooking vapors entry opening does not lead to the cooking vapors flow being influenced. On account thereof, undesirable flow losses can in particular be minimized, in particular avoided. However, in as far as this is desirable, turbulence-generating means can be incorporated in the cooking vapors flow.

According to one further aspect of the invention the at least one closure element is retrievable or removable. Said closure element can be retrieved from the cooking vapors entry installation in particular for cleaning purposes. A tool-less retrieval possibility is in particular provided. The closure element can in particular be capable of being plug-fitted in a simple manner through the cooking vapors entry opening. One or a plurality of guides, for example guide webs, can be provided for facilitating the correct alignment of the closure element when inserting the latter into the cooking vapors entry installation.

According to one further aspect of the invention the closure element is configured so as to be asymmetrical in such a manner that said closure element is capable of being inserted into the cooking vapors entry installation only in a specific alignment. Said closure element is in particular capable of being inserted through the cooking vapors entry opening into the cooking vapors entry installation exclusively in this correct alignment. On account thereof, the ease of operation for the user of the extractor device is improved.

According to one further aspect of the invention the extractor device comprises a suction installation for suctioning cooking vapors through the cooking vapors entry installation, wherein the activation installation for activating the at least one closure element is coupled in a signal-transmitting manner to a control installation for controlling the suction installation.

On account thereof, it is made possible for the activation, in particular the repositioning, of the closure element to be automated. It is in particular possible for the activation installation for activating the at least one closure element to be coupled to the control installation for controlling the suction installation in such a manner that the closure element in the event of any activation of the suction installation is automatically repositioned from the closed position to the second terminal position that unblocks the cooking vapors entry opening. Conversely, the closure element after switching-off the suction installation can be automatically repositioned to the first position that closes the cooking vapors entry opening. A follow-on operation of the suction installation can be provided and taken into account herein. It is in particular possible for the activation installation for activating the at least one closure element to be coupled to the control installation for controlling the suction installation in such a manner that the closure element after switching-off the suction installation is converted to the closed position only by way of a delay. The delay can be in the range from 1 min to 15 min, in particular in the range from 3 min to 10 min. The delay can also be controlled by sensors. Said delay can in particular be controlled so as to depend on the air humidity in a predefined measuring region of the cooking vapors entry installation.

According to one further aspect of the invention the extractor device comprises at least one sensor for detecting the repositioned position of the at least one closure element. Said sensor can in particular be connected in a signal-transmitting manner to the control installation for controlling the suction installation. It can be ensured on account thereof that the suction installation is activated or activatable, respectively, exclusively only when the cooking vapors entry opening is not closed by the closure element. It is in particular possible for the control installation for controlling the suction installation to be coupled to the sensor for detecting the repositioned position of the at least one closure element in such a manner that the suction installation is activatable only when the at least one closure element is in the respective second terminal position that unblocks the cooking vapors entry opening.

According to one further aspect of the invention the activation installation has a means for avoiding jamming. Said activation installation is in particular provided with a jamming guard. The jamming guard can be implemented by way of an electronic circuit. A resistance in the motion sequence of the closure element can in particular be identified by an excess current. This can lead to a reversal of the movement of the drive for repositioning the closure element.

The operational safety of the extractor device is improved on account thereof.

According to one further aspect of the invention the extractor device comprises a retrievable or removable collection tray for collecting liquids.

The collection tray serves in particular for collecting liquids that unintentionally enter through the cooking vapors entry opening. It can be prevented on account thereof that said liquids make their way into the suction installation. This leads to an enhanced safety of the extractor device.

The collection tray is in particular a component part of the cooking vapors entry installation. Said collection tray is in particular retrievable through the entry opening of said cooking vapors entry installation.

The collection tray is in particular from plastics material. Said collection tray is preferably latch-fittable to the housing of the cooking vapors entry installation. Said collection tray can be capable of being pushed or placed into the housing of the cooking vapors entry installation. Said collection tray per se can also form a component part of the housing of the cooking vapors entry installation.

The collection tray is in particular dishwasher safe. This facilitates the cleaning of said collection tray.

The collection tray in the flow direction is preferably disposed behind a filter element, in particular in the form of a filter insert.

The collection tray in the flow direction is in particular disposed ahead of a ventilator of the suction installation. The operational safety is increased on account thereof.

The collection tray has in particular a collection volume of at least 200 ml, in particular at least 300 ml, in particular at least 500 ml, in particular at least 1000 ml, in particular at least 1500 ml, in particular at least 2000 ml. The collection volume of the collection tray is usually smaller than 5 l, in particular smaller than 3 l.

According to one further aspect of the invention collection tray can be provided with a sensor installation for detecting an accumulation of liquid in said collection tray. The quantity of the liquid located in the collection tray is in particular detectable by means of the sensor installation.

The sensor installation can be coupled in a signal-transmitting manner to the activation installation for activating the at least one closure element. It is in particular possible for the activation installation for activating the at least one closure element to be coupled to the sensor installation of the collection tray in such a manner that the closure element when exceeding a specific predefined level of liquid, in particular a specific predefined quantity of liquid, in the collection tray is automatically converted to the closed position such that no further liquid can make its way into the cooking vapors entry installation.

According to one further aspect of the invention the extractor device comprises at least one sensor by means of which it is detectable whether a filter, in particular a grease filter, is inserted in the device. It can be in particular detected by means of the sensor whether the grease filter is correctly inserted in the device, that is to say whether the filter is in the correct operating position. The state of the grease filter, in particular the saturation level thereof, can optionally also be detected by sensors.

This can lead to improvements in the operation of the extractor device.

According to one further aspect of the invention the extractor device comprises a suction installation for suctioning cooking vapors through the cooking vapors entry installation. The suction installation comprises at least one ventilator having a ventilator housing, wherein the spacing between a base of the ventilator housing and an upper boundary of the cooking vapors entry installation in the direction perpendicular to the base of the ventilator housing is at most 30 cm, in particular at most 25 cm, in particular at most 20 cm.

The extractor device is thus distinguished in particular by a compact construction mode. Said extractor device can in particular be assembled in a commercially available item of kitchen furniture, in particular instead of a drawer in a kitchen base cabinet.

Sufficient space for the disposal of one or a plurality of hobs remains between the ventilator housing and the upper periphery of the cooking vapors entry installation, said upper boundary potentially coinciding substantially with the upper boundary of a worktop. The space between the ventilator housing and the upper boundary of the cooking vapors entry installation is in particular at least 10 cm.

A carbon filter element can adjoin the ventilator housing. Also in the case of said carbon filter element, the spacing between the base and the upper boundary of the cooking vapors entry installation is preferably at most 30 cm, in particular at most 25 cm, in particular at most 20 cm. The spacing between the base of the carbon filter element and the upper boundary of the cooking vapors entry installation is in particular at most as large as the spacing between the base of the ventilator housing and the upper boundary of the cooking vapors entry installation.

According to one further aspect of the invention the ventilator housing can have an integrated sound insulation. It can in particular be provided for a sound-insulating mat to be disposed on the internal side of the ventilator housing.

According to one further aspect of the invention, an intake space is provided between the ventilator motor and the cooking vapors entry opening. The intake space is in particular disposed above the ventilator motor.

According to one further aspect of the invention the ventilator housing has an exhaust opening. The exhaust opening is in particular disposed in a plane which in relation to the plane defined by the cooking vapors entry opening encloses an angle of 90°.

The exhaust opening has an available cross section of at least 100 $cm^2$, in particular at least 150 $cm^2$, in particular at least 200 $cm^2$, in particular at least 250 $cm^2$, in particular at least 300 $cm^2$, in particular at least 350 $cm^2$, in particular at least 500 $cm^2$. The available cross section of the exhaust opening is in particular at most 1000 $cm^2$.

According to one further aspect of the invention the extractor device in the region of the cooking vapors entry opening has a width of at most 20 cm, in particular at most 15 cm, in particular at most 12 cm, in particular at most 10 cm, in particular at most 8 cm, in particular at most 5 cm.

This enables a space-saving disposal of the extractor device in particular between two hobs According to one further aspect of the invention the cooking vapors entry installation has an installation frame. The installation frame can be replaceable. Said installation frame can in particular be provided in different embodiments, in particular having different depths. The installation frame can in particular have a depth of up to 50 cm, a depth in the range from 50 cm to 60 cm, a depth in the range from 60 cm to 70 cm, or a depth in the range from 70 cm to 80 cm. According to one advantageous variant the installation frame can have a flexibly adjustable depth. Said installation frame can in particular have an adaptable depth.

The flexibility in the installation of the extractor device is increased on account thereof.

The extractor device by means of the installation frame is adaptable in a simple manner to the dimensions of different hobs.

According to one further aspect of the invention the extractor device is a component part of a modular system. The extractor device can in particular be a component part of a hob system having one or a plurality of hobs. The hobs are preferably configured so as to be modular. This is intended to mean that the hobs can be chosen substantially freely from a selection of different hobs and be combined with the extractor device.

The hobs can in each case have a dedicated control unit. Alternatively thereto, it is possible for a separate central control unit for controlling all of the hobs to be provided. Said control unit can also serve for controlling the extractor device. Said control unit can be configured as a separate module. Said control unit can also be integrated in the extractor device.

A further object of the invention lies in improving an item of kitchen furniture. This object is achieved by an item of kitchen furniture having an extractor device according to the preceding description.

It is in particular possible for the extractor device to be integrated in the item of kitchen furniture already ex works. The compact construction mode of the extractor device can be particularly well utilized herein. It is in particular possible for the dimensions and/or the apportionment of the item of kitchen furniture to be adapted in a precise and targeted manner to the dimensions of the extractor device.

The item of kitchen furniture can in particular be a kitchen base cabinet.

The item of kitchen furniture can also comprise a worktop.

Said item of kitchen furniture can be configured as a free-standing item of kitchen furniture or as a modular item of furniture for integration in a kitchen unit having further items of furniture.

Moreover, one or a plurality of hobs can be integrated in the item of kitchen furniture.

According to one alternative it is provided for only the extractor device but no hobs to be integrated in the item of kitchen furniture. The item of kitchen furniture in this case can be embodied so as to be particularly narrow. It can in particular have a width of at most 30 cm, in particular at most 25 cm, in particular at most 20 cm. It can be provided in this case for the ventilator housing to be disposed so as to be rotated by 90° relative to the disposal according to the preceding description.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

The general component parts of a hob system 1 will first be described hereunder. The hob system 1 comprises at least one hob 2. Two hobs 2 are provided in the case of the hob system 1 illustrated in exemplary manner in FIG. 1. The hobs 2 can be substantially arbitrary hobs. Said hobs 2 can in particular be induction hobs, gas hobs, Teppanyaki hobs, hobs for a wok, electric hobs, or hotplates, grills, or other hobs.

Figure 1:
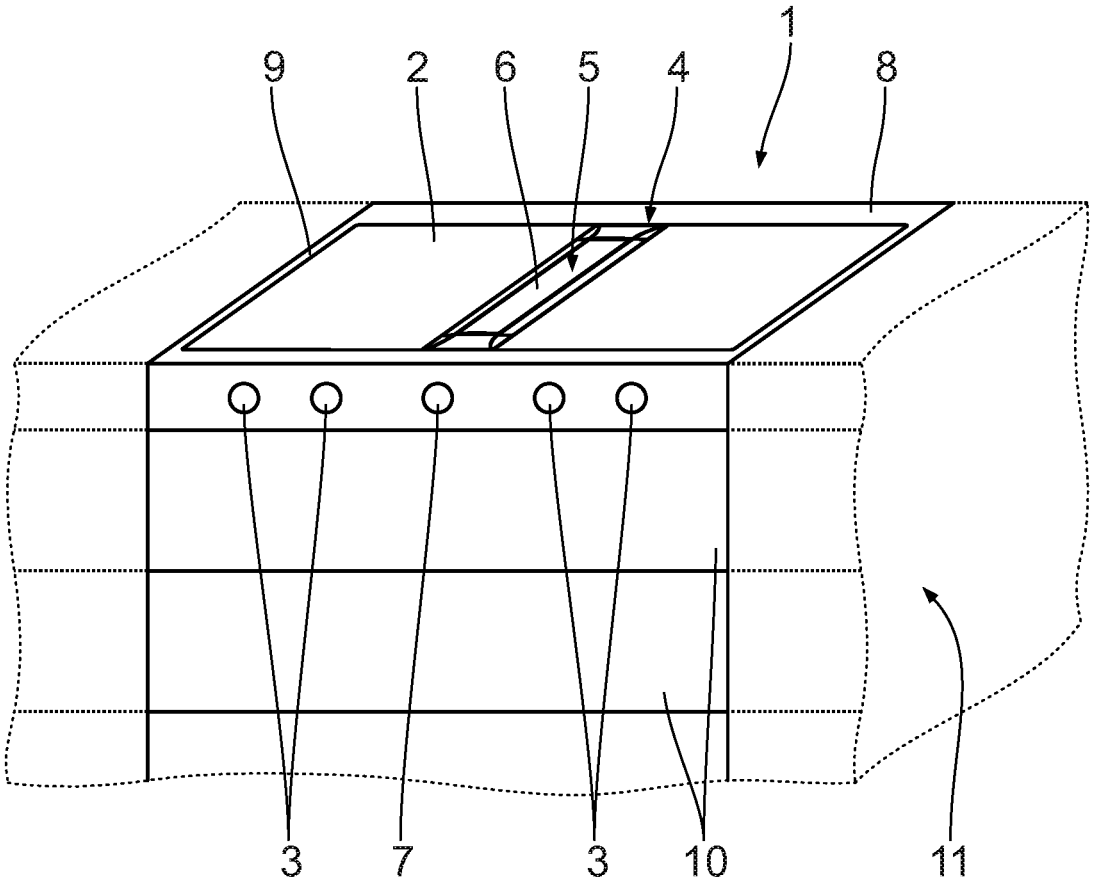
FIG. 1 is a schematic view of a hob system having two hobs and a downdraft ventilator disposed therebetween.

Control knobs 3 are in each case provided for operating the hobs 2 in the case of the alternative illustrated in exemplary manner in FIG. 1. An operation by means of touch-sensitive sensors which can in particular be integrated in the hobs 2 is likewise possible. An operation by way of a separate operating module is also conceivable. In this case, the hobs 2 can be configured so as to be non-autonomous, that is to say without dedicated control electronics. The construction of the hobs 2 can be simplified on account thereof. It is in particular possible for the construction height of the hobs 2 to be reduced. Said construction height can in particular be at most 10 cm, in particular at most 6 cm, in particular at most 5 cm, in particular at most 4 cm, in particular at most 3 cm, in particular at most 2 cm.

The hob system 1 furthermore comprises a downdraft ventilator 4. The downdraft ventilator 4 forms a device for extracting cooking vapors.

Figure 2:
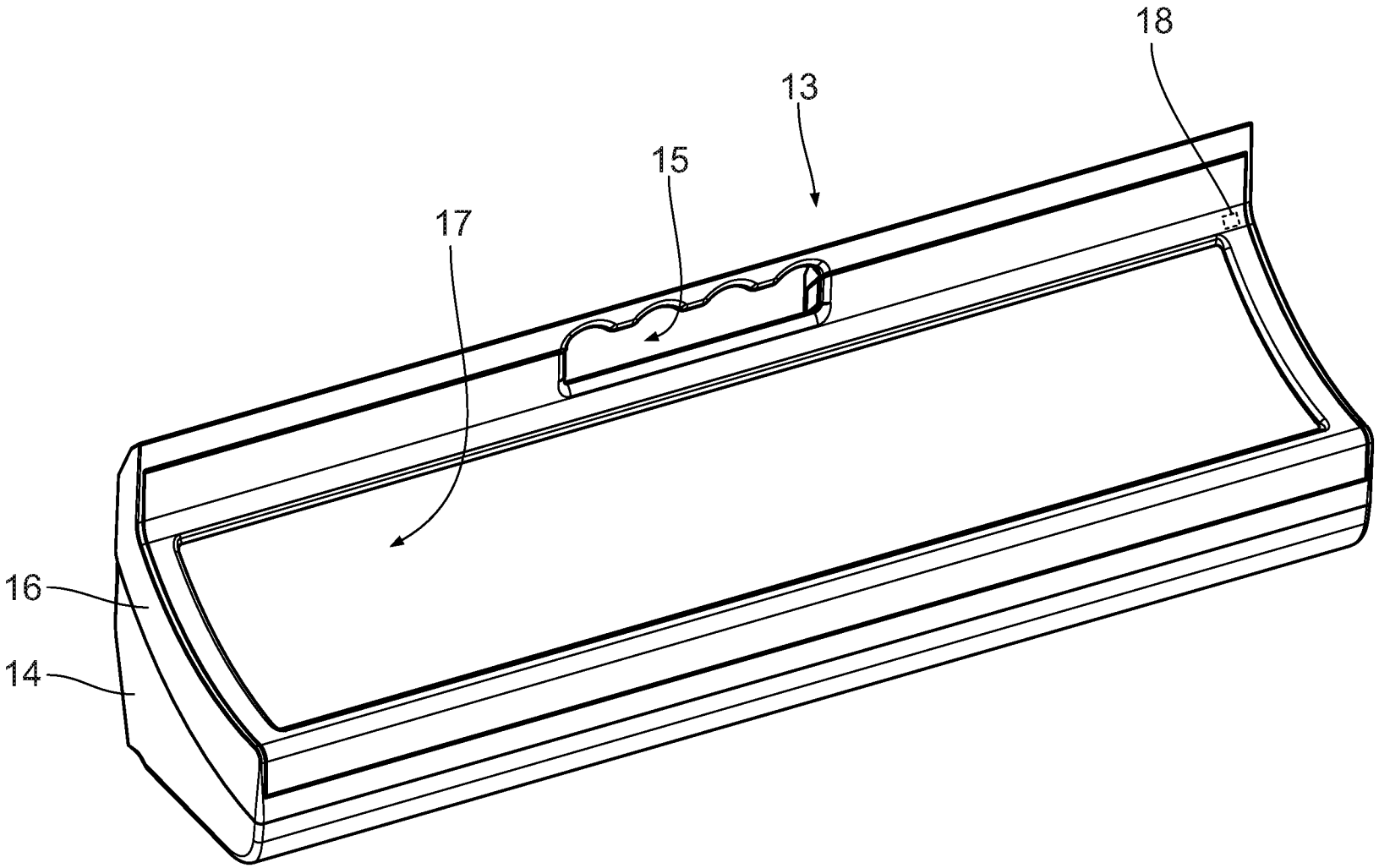
FIG. 2 is a perspective view of an insert for a downdraft ventilator.

The downdraft ventilator 4 in the case of the alternative illustrated in FIG. 2 is disposed between the two hobs 2. Said downdraft ventilator 4 can also be disposed so as to be lateral to the hobs 2 or in the region behind the hobs 2.

Said downdraft ventilator 4 can have a round, in particular a circular, cooking vapors entry opening 5. The cooking vapors entry opening 5 in the case of the alternative illustrated is configured so as to be elongate, in particular rectangular. The cooking vapors entry opening 5 has an aspect ratio of in particular at least 2:1, in particular at least 3:1, in particular at least 5:1, in particular at least 10:1. The aspect ratio of the cooking vapors entry opening 5 is usually at most 100:1, in particular at most 50:1.

A plurality of cooking vapors entry openings 5 can also be provided. It is in particular possible for two or more cooking vapors entry openings 5, in particular slot-shaped cooking vapors entry openings 5, to be provided. Said cooking vapors entry openings 5 can in particular be aligned so as to be mutually parallel.

The cooking vapors entry opening 5 is reversibly closable in particular by means of a closure element 6. In the case of a plurality of cooking vapors entry openings 5, the latter can in each case be reversibly closable in a separate manner, that is in a mutually independent manner, by means of closure elements 6.

A control knob 7 is provided for operating the downdraft ventilator 4. An operation by means of a touch-sensitive sensor is likewise possible.

The downdraft ventilator 4 is in particular disposed in the region of a hob plane 8. Said downdraft ventilator 4 serves for extracting cooking vapors from the region above the hob plane 8 to a region below the hob plane 8. Said downdraft ventilator 4 is therefore also referred to as a downdraft system (downward extraction).

The cooking vapors entry opening 5 is preferably disposed so as to be locationally fixed relative to the hob plane 8.

According to one alternative (not illustrated in the figures), the region of the downdraft ventilator 4 having the cooking vapors entry opening 5 is repositionable in the direction perpendicular to the hob plane 8.

It can be provided for the cooking vapors entry opening 5 to be disposed a few millimeters above the hob plane 8. On account thereof, the risk of an unintentional ingress of liquid into the downdraft ventilator 4 can be significantly reduced, in particular in the case of liquids boiling over. It can in particular also be provided for the cooking vapors entry opening 5 to be configured in such a manner that the latter in the operation of the downdraft ventilator 4 is repositionable to a position a few millimeters above the hob plane. In the switched-off state of the downdraft ventilator 4 said cooking vapors entry opening 5 in this case can be disposed so as to be flush with the hob plane 8.

The hob system 1 is configured so as to be modular. In this case, hobs 2 that can be substantially freely chosen can be flexibly combined with one or a plurality of the downdraft ventilators 4.

The hob system 1 can also be configured as an assembled unit. In this case, one or a plurality of hobs 2 having one or a plurality of downdraft ventilators 4 are integrated in a single system. Said hobs 2 and said downdraft ventilators 4 are in particular disposed in a common housing. Said common housing for assembly has only to be inserted in a clearance in a worktop 9.

Compartments, in particular drawers 10, of a kitchen base cabinet 11 in the region below the hob system 1 can be utilized substantially without any restriction.

The kitchen base cabinet 11 in general terms forms an item of kitchen furniture. The hob system 1, in particular the downdraft ventilator 4, can be integrated in the item of kitchen furniture. Said hob system 1 and said downdraft ventilator 4 can in particular be integrated in the item of kitchen furniture ex works.

The assembled unit, in particular the downdraft ventilator 4, preferably has an overall construction height h in the range of less than 30 cm, in particular less than 25 cm, in particular less than 20 cm, in particular less than 18 cm, in particular less than 16 cm, in particular less than 15 cm. The assembled unit for installation does in particular not require more space below the worktop 9 than a normal cutlery drawer.

In terms of respective details and further information pertaining to the general construction of the hob system 1, reference is to be made to EP 2 702 329 A1 and corresponding U.S. patent, U.S. Pat. No. 10,006,641, and corresponding U.S. patent publications, US 2014/048057 and US 2018/33521. The contents of each of EP 2 702 329 A1, U.S. Pat. No. 10,006,641, US 2014/048057 and US 2018/335217 are incorporated herein by reference.

Figure 3:
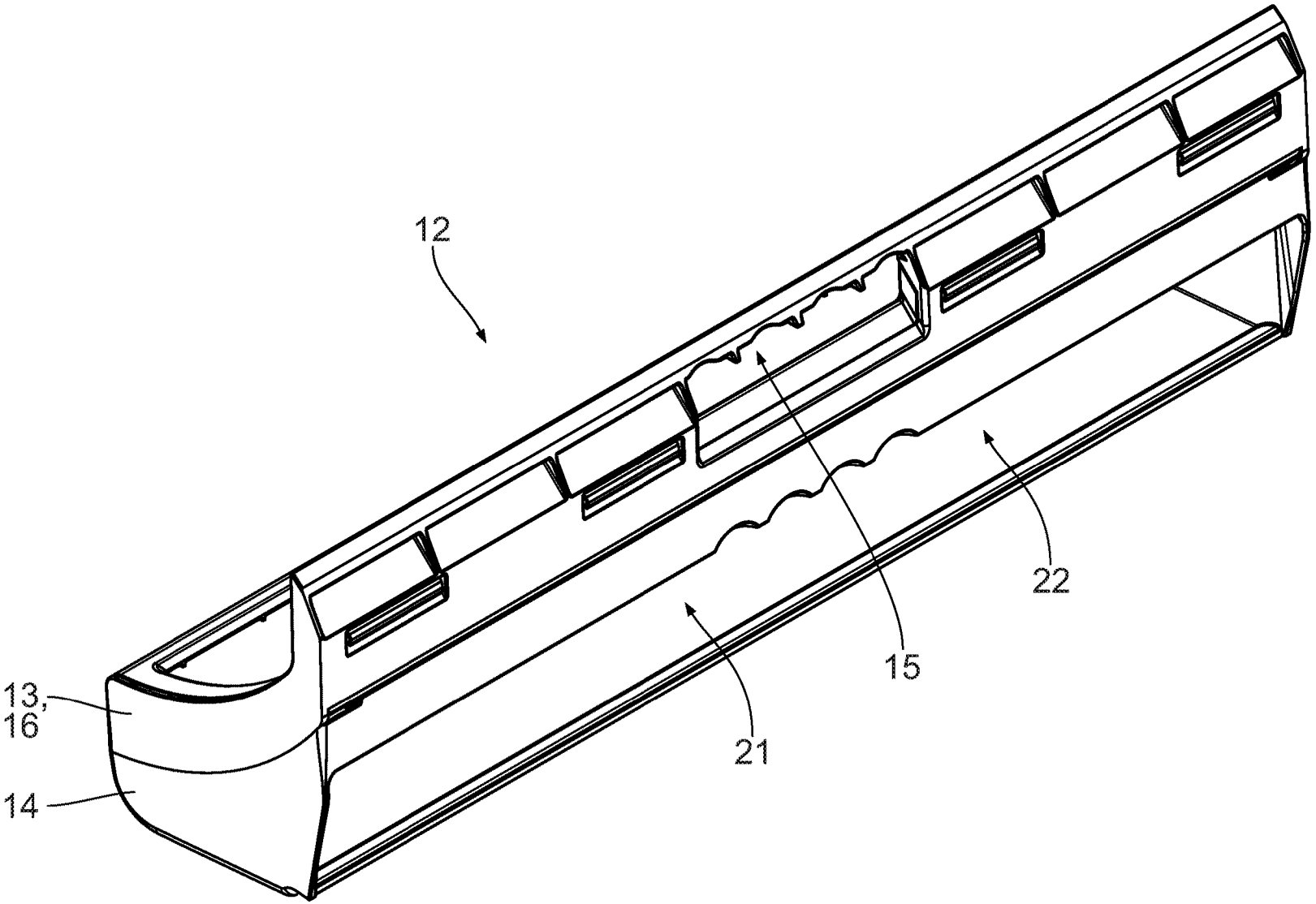
FIG. 3 is a perspective view of the insert according to FIG. 2 from another viewing angle.
Figure 4:
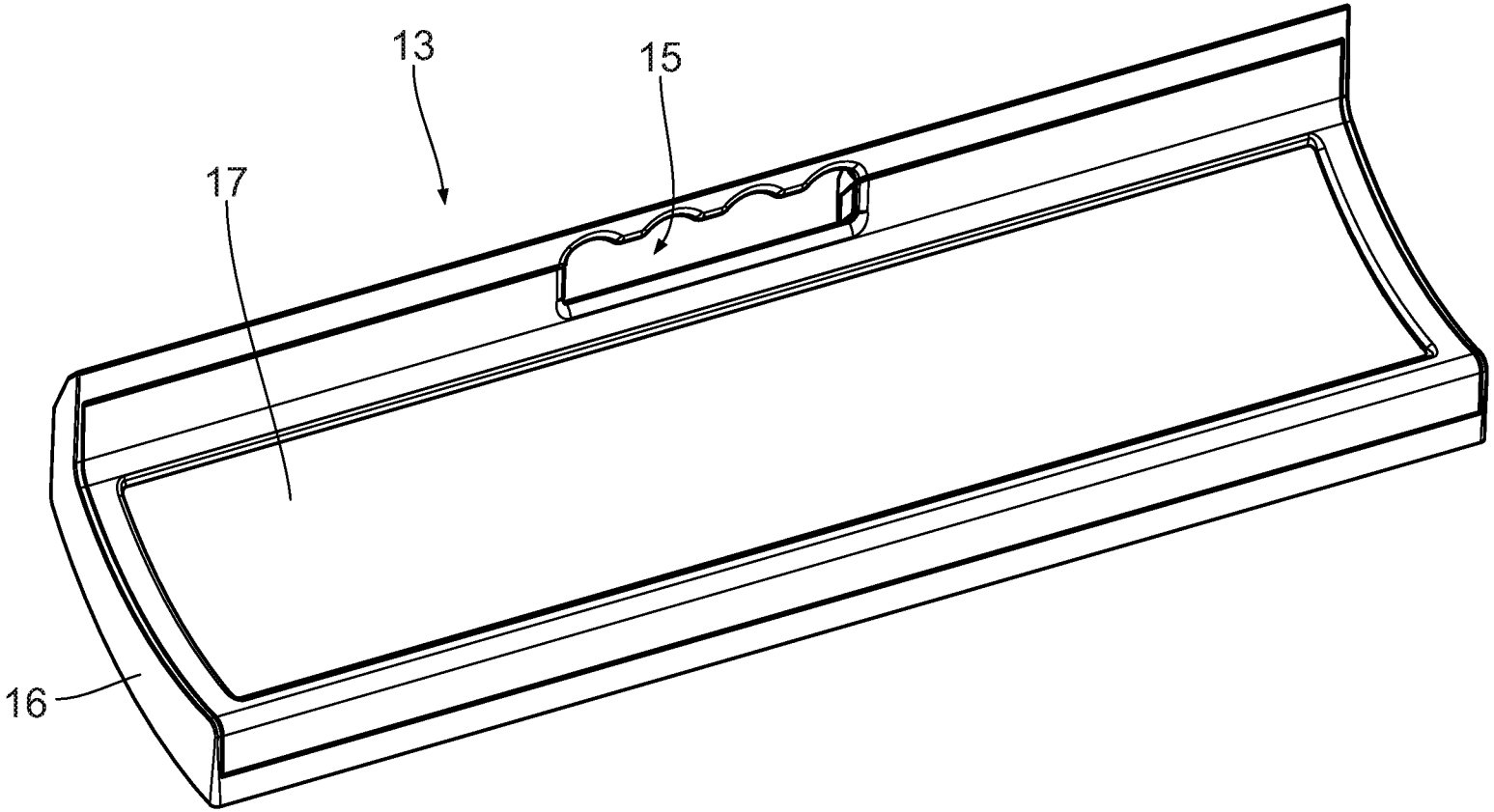
FIG. 4 is a view of the filter element of the insert according to FIG. 2.

Further features of the downdraft ventilator 4, in particular of a cooking vapors entry installation 41 thereof, will be described hereunder with reference to FIGS. 2 to 4. Only a fragment of the downdraft ventilator 4 from the region of the cooking vapors entry installation 41 is in particular illustrated in each case in FIGS. 7 to 11. Component parts of the downdraft ventilator 4 that are downstream in the flow direction 27 are not illustrated in these figures for reasons of clarity.

Figure 5:
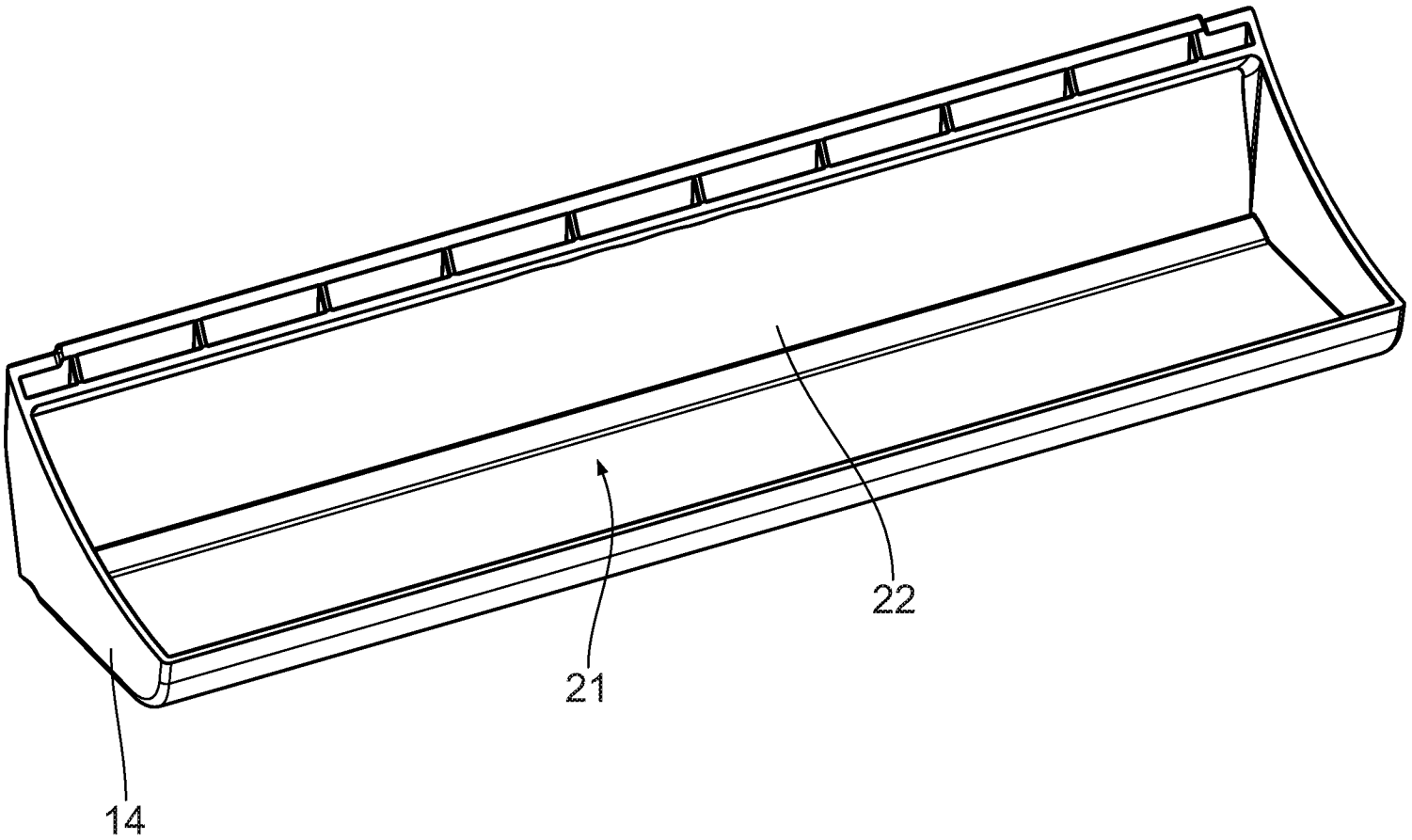
FIG. 5 is a view of the collection element of the insert according to FIG. 2.
Figure 6:
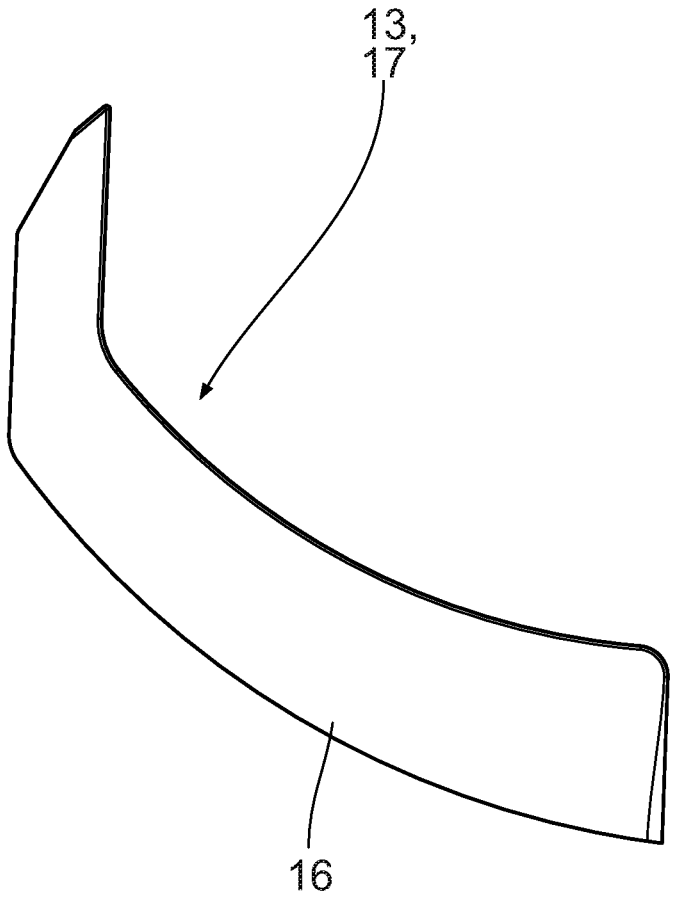
FIG. 6 is a side view of the filter element according to FIG. 4.
Figure 7:
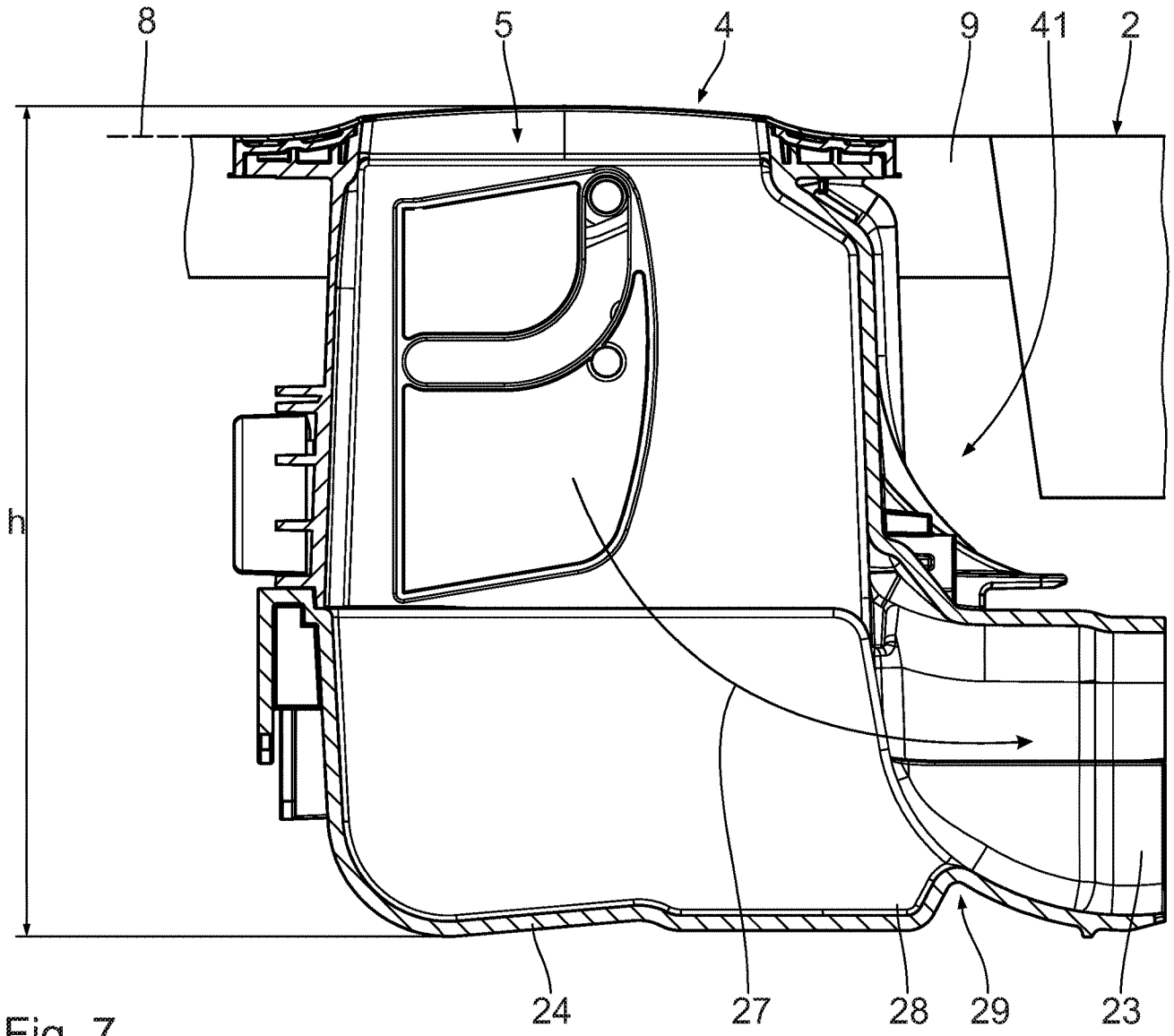
FIG. 7 is a schematic sectional view through a hob system in the region of a downdraft ventilator, wherein the collection element of the insert has been retrieved.
Figure 8:
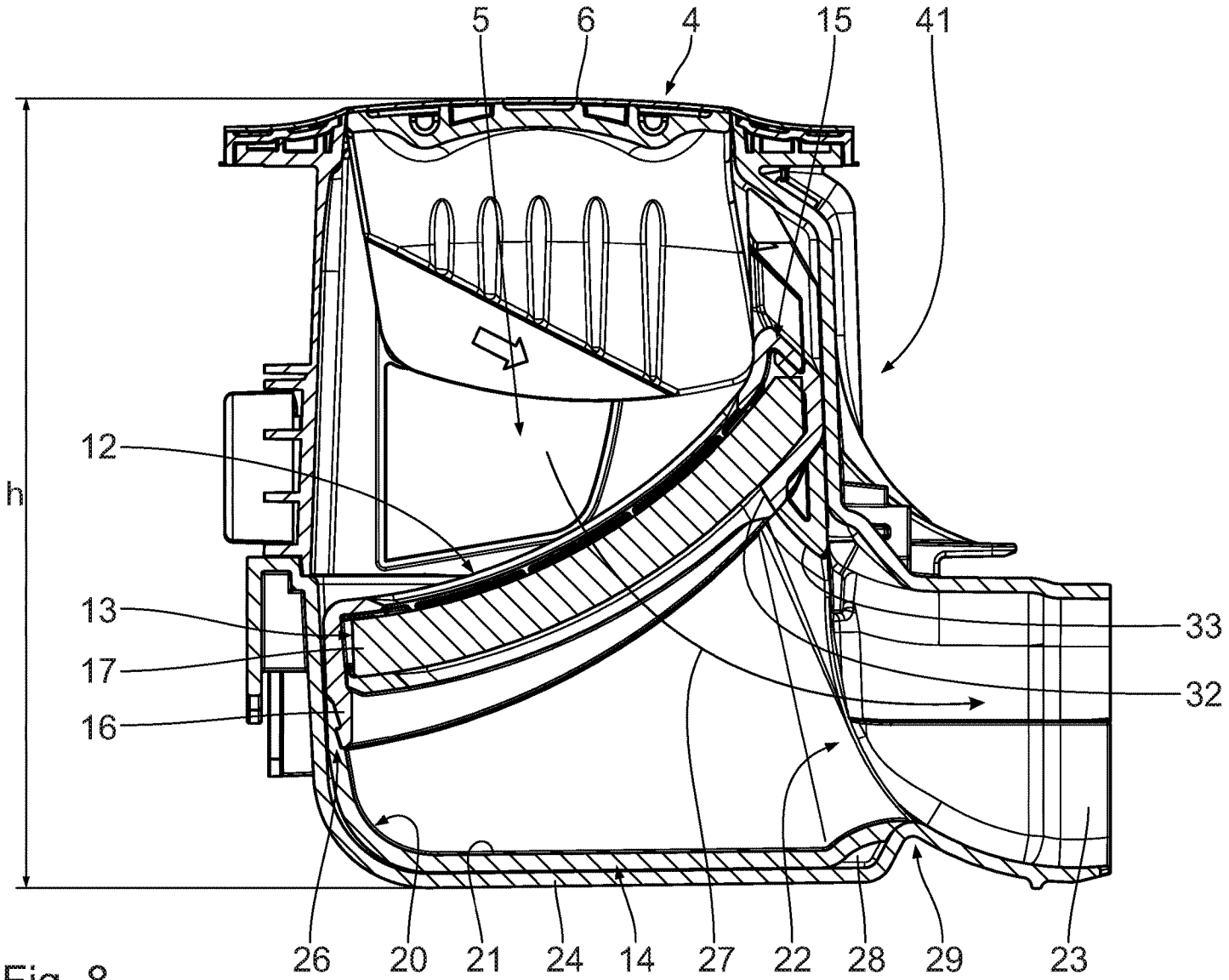
FIG. 8 is a view according to FIG. 7, having an insert inserted in the downdraft ventilator.

The downdraft ventilator 4 comprises an insert 12. An alternative of the insert 12 is illustrated in an exemplary manner in FIGS. 2 and 3. The insert 12 is configured in multiple parts. Said insert 12 comprises a filter element 13 and a collection element 14. The filter element 13 and the collection element 14 are capable of being separated from one another. The filter element 13 is illustrated without the collection element 14 in FIG. 4. The collection element 14 is illustrated without the filter element 13 in FIG. 5.

The filter element 13 is retrievable from the downdraft ventilator 4. Said filter element 13 is in particular retrievable from the downdraft ventilator 4 independently of the collection element 14.

In order for the retrieval capability to be simplified, the filter element 13 has a handle 15. The handle 15 can be configured in the form of a recess grip. Said handle 15 is in particular configured so as to be ergonomically favorable, in particular so as to be adapted to the usual size of fingers of a human hand.

The filter element in turn is configured in two parts. Said filter element has a frame 16. The frame 16 is configured so as to be dimensionally stable. Said frame 16 can in particular be from plastics material. According to one alternative the frame 16 is configured from metal, in particular from aluminum, or stainless steel. Other materials, for example carbon, are likewise possible. The frame 16 is in particular from a moisture-resistant and heat-resistant material.

The filter element 13 moreover comprises the actual filter 17. The filter 17 comprises a plurality of tiers from a woven filter fabric. The filter tiers are preferably from stainless steel. The filter 17 can in particular have a plurality, in particular at least three, in particular at least five, in particular eight or more tiers, in particular double tiers. The tiers can comprise a knitted stainless steel fabric. Said tiers can in particular be composed of a knitted mesh fabric on both sides.

The filter 17 is in particular a grease filter.

The downdraft ventilator 4, in particular the system comprising the retrievable component parts of the downdraft ventilator 4, in particular the system comprising the filter 17, the collection element 14, as well as an optionally present collection tray 28, has a grease separation rate of more than 45%, in particular more than 55%, in particular more than 65%, in particular more than 75%, in particular more than 85%, in particular more than 95%. This information relates to the grease separation rate according to DIN EN 61591.

The filter 17, in particular the filter tiers, are configured so as to be curved.

A flow-optimized construction mode of the filter element 13 can be achieved by a curved shape.

The filter element 13 is dishwasher safe. Said filter element 13 for cleaning can be simply retrieved from the downdraft ventilator 4 and be placed in the dishwasher.

A signal transducer 18 is disposed on the frame 16. A magnet serves as the signal transducer 18. Alternatively thereto, the signal transducer 18 can also be configured as an electric contact, or in mechanical manner, for example as a protrusion, in particular in the form of a latching cam.

With the aid of the signal transducer 18 it can be detected by way of a suitable sensor element in the downdraft ventilator 4 whether or not the filter element 13 is correctly inserted in the downdraft ventilator 4. The respective sensor is preferably connected in a signal-transmitting manner to a control installation 85 for the downdraft ventilator 4.

The collection element 14 is likewise retrievable from the downdraft ventilator 4. The collection element 14 to this end has a handle 19. In terms of the configuration of the latter, reference is to be made to the description of the handle 15 of the filter element 13.

The collection element 14 is configured so as to match the filter element 13. The two elements 13, 14 are in particular plug-fittable in or to one another in a form-fitting manner. Said two elements 13, 14 in the plug-fitted state have in particular an internal wall 20 that is configured so as to be substantially free of edges. The internal wall 20 is configured so as to be curved. Said internal wall 20 forms a flow-directing face for deflecting the flow of cooking vapors. The flow-directing face is configured so as to be substantially free of edges, preferably so as to be smooth. The profile of the flow-directing face, in particular the cross section thereof relative to a vertical plane, in particular relative to a vertically aligned central plane of the downdraft ventilator 4, can be described in particular by way of a continuous function, in particular a differentiable function, in particular by way of a continuously differentiable function. The flow-directing face can have a consistent curvature. The flow-directing face can also have a curvature that is variable in the flow direction. Said flow-directing face, in particular in a peripheral region that faces the cooking vapors entry opening 5, can be configured so as to be substantially planar. Said flow-directing face, in particular in a peripheral region that faces the cooking vapors exit opening 22, can be configured so as to be substantially planar. In this case, said flow-directing face is configured so as to be curved only in the region between said peripheral regions.

The collection element 14 serves for receiving liquids. Said collection element 14 to this end has a collection tray 21 or at least one tray-type region. The collection tray 21 has a collection volume of at least 50 ml, in particular at least 100 ml, in particular at least 200 ml, in particular at least 300 ml, in particular at least 500 ml, in particular at least 700 ml.

The collection element 14 is from a dimensionally stable material. The collection element 14 is in particular from plastics material. Said collection element 14 can also be from metal, in particular from aluminum, or stainless steel. The collection element 14 can also be produced from other materials, for example from carbon, or comprise materials of this type. The collection element 14 is in particular produced exclusively from moisture-resistant materials. Said collection element is in particular heat resistant to temperatures up to 75° C., in particular up to 80° C., in particular up to 95° C., in particular at least 100° C.

The collection element 14 has a cooking vapors exit opening 22. A duct 23 for discharging cooking vapors adjoins the cooking vapors exit opening 22 in the inserted state of the collection element 14 in the downdraft ventilator 4. The transition from the collection element 14 to the duct 23 is in particular configured so as to be substantially free of edges. Said transition is preferably configured so as to be flow-optimized in such a manner that, apart from targeted dead space and/or turbulence regions, a substantially turbulence-free cooking vapors flow is enabled. The flow cross section in the flow direction behind the grease filter 17 can initially increase. The flow cross section after a deflection reduces in a region adjoining said deflection. The flow-mechanical properties of the downdraft ventilator 4, in particular of the insert 12, were able to be improved by way of a rounded configuration of the internal and/or external wall that limits/limit the flow regions, in particular in the region of the deflection, in particular by way of avoiding kink points in this region. It was possible in particular for flow losses to be reduced.

The collection element 14 in the inserted state bears on a base wall 24 of the downdraft ventilator 4, in particular of the duct 23 for discharging the cooking vapors. The collection element 14 is retrievable in an upward manner, in particular a vertically upward manner, in particular once the filter element 13 has been retrieved from the downdraft ventilator 4.

The collection element 14 has a flow-optimized shape. Said collection element 14, in particular on the internal side thereof that faces the flow region, is configured so as to be substantially free of edges.

The collection element 14, in particular the collection tray 21, can bear so as to be flush in a collection tray 28 in the duct 23. Said collection element 14, in particular at least in the regions, bears flush on the collection tray 28. On account thereof, an air flow in the region between the collection tray 21 of the filter element 13 and the collection tray 28 in the dock 23 can be avoided.

The collection element 14 is configured in such a manner that the position of the center of mass 25 thereof relative to the handle 19 facilitates, in particular initiates, a pivoting of the collection element 14 about a horizontally running axis, this simplifying the insertion of the collection element 14 into the downdraft ventilator 4. The center of mass 25 of the collection element 14 relative to the handle 19 is disposed in particular in such a manner that the horizontal extent of the collection element 14, when the latter is suspended on the handle 19, is reduced, in particular minimized, as compared to the maximum horizontal extent in the correctly inserted state. The collection element 14 is automatically pivoted in the event of the collection element 14 being retrieved on the handle 19. The retrievability of the collection element 14 can be facilitated on account thereof.

The collection element 14 can be provided with guide means which lead to a self-centering embodiment of the collection element 14 when inserted into the downdraft ventilator. For example, one or a plurality of grooves, webs, protrusions, bulges, or clearances can serve as guide means The filter element 13 and the collection element 14 are in particular capable of being plug-fitted to one another. To this end, said filter element 13 and said collection element 14 have mutually adapted connection means 26 in the form of protrusions or clearances, respectively. The filter element 13 and the collection element 14 in the state plug-fitted to one another form a substantially continuous, in particular smooth, surface that is substantially free of edges.

The collection element 14 and the filter element 13 are preferably configured in such a manner that said collection element 14 and said filter element 13 when inserted into the downdraft ventilator 4 guide one another in a self-acting manner to the correct relative positioning. To this end, guide means, in particular in the form of clearances, in particular guide grooves and protrusions interacting therewith on the external walls of the filter element 13 and of the collection element 14, or on the internal side of the downdraft ventilator 4, respectively, can be provided.

The collection element 14 in the flow direction 27 of the cooking vapors flow in the downdraft ventilator 4 is disposed so as to be downstream of the filter element 13. Exiting liquids and grease can thus be collected in the collection element 14 behind the filter element 13 in the flow direction 27.

A collection tray 28 is preferably configured in the duct 23 for discharging the cooking vapors per se. A liquids barrier in the form of an upwardly projecting cam 29 is configured to this end in the duct 23. The collection tray 21, or the lower edge of the cooking vapors exit opening 22, respectively, lies substantially flush on the cam 29 in the state of the collection element 14 inserted in the downdraft ventilator 4.

The collection tray 28 can be configured so as to be removable or retrievable. Said collection tray 28 can in particular be latch-fittable to the duct 23, in particular to the remainder of the duct 23. Said collection tray 28 is in particular attachable to or in the duct 23 in such a manner that said duct 23 by way of the collection tray 28 is closed in a liquid-tight manner in relation to the outside.

The collection tray 28 can remain in the extractor guide even when the collection element 14 together with the collection tray 21 is retrieved from the downdraft ventilator 4. The collection tray 28 which is also referred to as the maintenance tray, is usually retrieved only for maintenance work on the downdraft ventilator 4 or in the case of a severe contamination.

The insert 12 in the inserted state forms a component part of a duct for deflecting and discharging the cooking vapors flow. In other words, the insert 12 has in particular a flow-directing function. In other words, the internal wall 20 serves as a flow-directing face for the cooking vapors flow. The flow of the cooking vapors is substantially improved on account of the configuration of said internal wall 20, in particular on account of the curved, substantially edge-three, configuration. Undesirable turbulences and in particular dead spaces are largely avoided. According to one advantageous alternative, the internal wall 20 can be provided with a structured feature for further improving the flow conditions in the downdraft ventilator 4.

The cooking vapors entry installation 41 has an overall construction height h of approximately 15 cm. The overall construction height h of the cooking vapors entry installation 41 is in particular at most 30 cm, in particular at most 20 cm, in particular at most 15 cm. Said overall construction height h is preferably at least 5 cm, in particular at least 10 cm. Said cooking vapors entry installation 41 thus has a compact configuration, on the one hand, but is optimized with a view to the flow-mechanical properties thereof, on the other hand. Moreover, said cooking vapors entry installation 41 is configured in such a manner that hobs 2 can be disposed in the worktop 9 in the region of the hob plane 8 beside the cooking vapors entry installation 41, without said hobs 2 colliding with components of the downdraft ventilator 4 which are downstream of the cooking vapors entry installation 41 in the flow direction 27. Said cooking vapors entry installation 41 is in particular configured in such a manner that sufficient space remains for disposing a hob 2 in the worktop 9 between an upper delimitation of the duct 23 and the hob plane 8 in the region of the duct 23, in particular in the region of a cooking vapors exit opening of the cooking vapors entry installation 41, in which region the duct 23 is connected in a flow-directing manner to downstream components of the downdraft ventilator 4.

Figure 9:
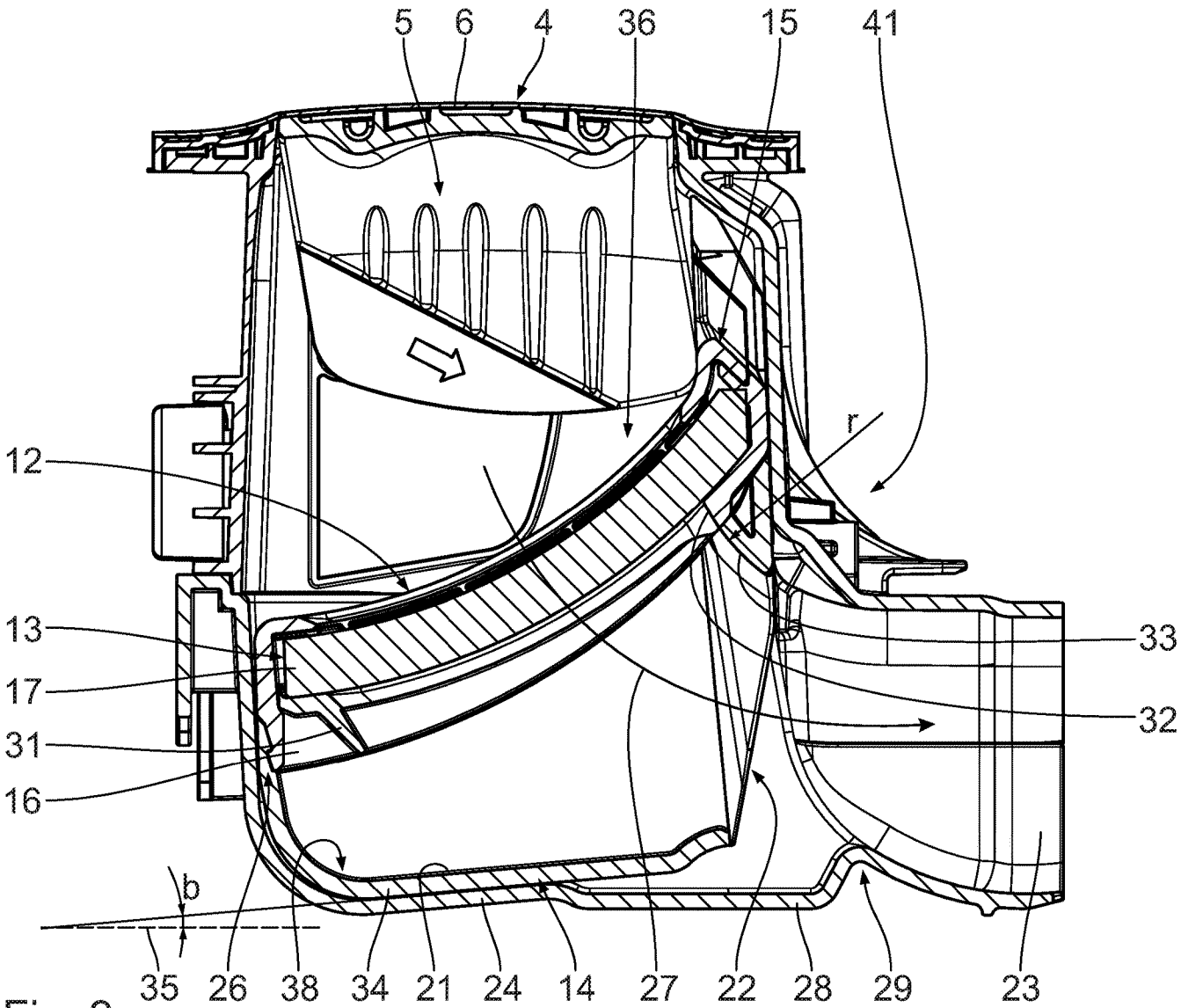
FIG. 9 is a view according to FIG. 8, having a further alternative of an insert for the downdraft ventilator.

An alternative of the insert 12 is described hereunder with reference to FIG. 9. The alternative according to FIG. 9 substantially corresponds to the alternative according to FIG. 8, reference herewith being made to the latter.

In the case of the alternative illustrated in FIG. 9, a flow-directing means 31, in particular in the form of a flow-directing element or a flow-directing plate is provided on the frame 16 of the filter element 13 on the external side of the deflection of the flow direction 27 of the cooking vapors flow. The flow-directing means 31 is in particular aligned so as to be substantially parallel with a further flow-directing means 32 in the region of the internal radius r of the deflection region for the cooking vapors flow. The flow-directing means 32 continues in a flow-directing face 33 of the collection element 14. A flow-directing element, in particular a flow-directing plate preferably serves as a flow-directing means 32.

The flow-directing means 31, 32 are from the same material as the frame 16 of the filter element 13 and/or the collection tray 21. Said flow-directing means 31, 32 are in particular from plastics material.

The flow-directing face 33 forms a transition, in particular a rounded transition, in particular a substantially edge-free transition, toward the duct 23. A deflection of the cooking vapors flow about a sharp edge on the internal side of the deflection region is in particular avoided by means of the flow-directing means 32 and the flow-directing face 33. The flow-mechanical properties of the downdraft ventilator 4 are significantly improved on account thereof.

The deflection region for the cooking vapors flow in the region of the internal radius thereof has in particular a curvature radius of at least 1 cm, in particular at least 2 cm, in particular at least 3 cm, in particular at least 5 cm.

The collection tray 21 of the collection element 14 in the case of the alternative illustrated in FIG. 9 has a base face 34 which is configured so as to slightly ascend in the direction toward the cooking vapors exit opening 22. The base face 34 in the inserted state of the insert 12 has in particular an angle b in the range from 3° to 30°, having a horizontal plane 35. The angle b is in particular at least 5°, in particular at least 10°. Said angle b is in particular at most 20°, in particular at most 15°. It is achieved on account of the inclined configuration of the base face 34 that liquids that accumulate in the collection tray 21 accumulate in a rear region 38 of the collection tray 21. The rear region 38 herein is referring to that region on the base of the collection tray 21 that is opposite the cooking vapors exit opening 22. The rear region 38 forms a collection region for the liquids to be collected. Said rear region 38 moreover forms a collection region for grease running from the grease filter 17.

The base wall 24 of the collection tray 28 at least in regions is likewise configured so as to be inclined in relation to the horizontal plane 35. The base face 34 of the collection tray 21 at least in regions lies in particular so as to be flush on the base wall 24 of the collection tray 28.

The handle 15 of the filter element 13 is disposed outside a flow region 36 of the cooking vapors flow. The flow region 36, in particular in the extension of the cooking vapors entry opening 5, extends perpendicularly downward, in particular so as to be perpendicular to the horizontal plane 35. By way of a disposal of the handle 15 outside the flow region 36 it can be avoided that the handle 15 leads to turbulences of the cooking vapors flow. A further alternative of the insert 12 will be described hereunder with reference to FIG. 10. The alternative according to FIG. 10 corresponds substantially to the alternative according to FIG. 9, reference herewith being made to the description of the latter.

Figure 10:
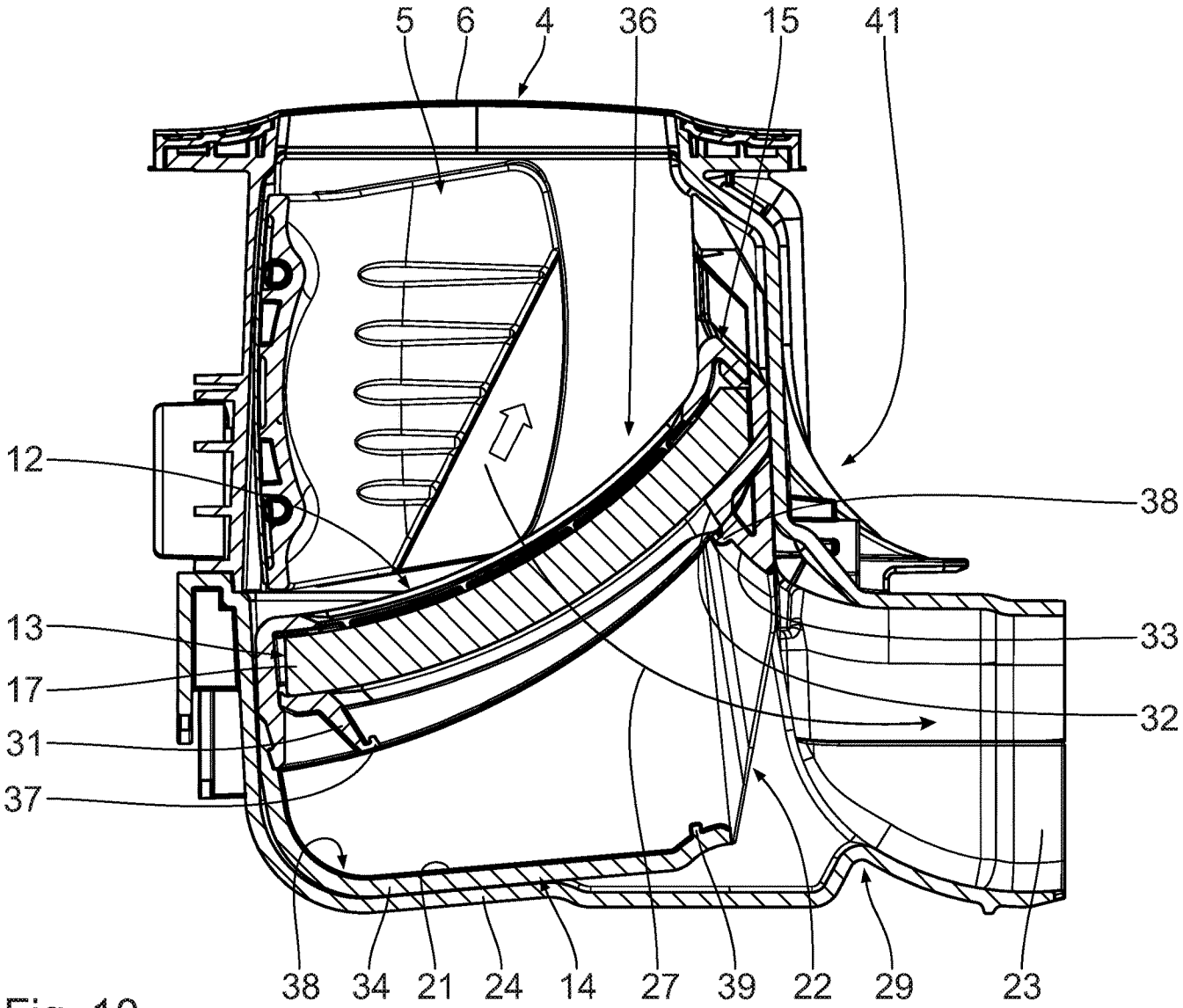
FIG. 10 is a view according to FIG. 8, having a further alternative of an insert for the downdraft ventilator.

In the case of the alternative according to FIG. 10 a hook 37 is disposed on the flow-directing element 31. The hook 37 is disposed on that side of the flow-directing element 31 that faces the deflection region. Said hook 37 serves for generating turbulences in the cooking vapors flow in a targeted manner. In other words, said hook 37 forms a means for generating turbulences. Turbulences of this type can be utilized for increasing the grease separation rate in the insert 12. The grease separation rate in the collection element 14 can in particular be increased by means of the hook 37.

Corresponding hooks 38, 39 are provided on the internal side of the deflection region, in particular on the flow-directing face 33, and in the region of that end of the base face 34 that faces the cooking vapors exit opening 22.

The collection element 14 is thus provided with a plurality of turbulence-generating means.

In the case of the of above-described alternatives the filter element 13 and the collection element 14 form in each case separate or separable component parts of the insert 12. This is not mandatory. The collection element 14 can in particular also be configured so as to be integral to the filter element 13. A configuration of the insert 12 that in flow-mechanical terms is particularly favorable can be achieved on account thereof. The insert 12 in this case forms a filter collection insert.

A further alternative of the insert 12 will be described hereunder with reference to FIG. 11. The alternative according to FIG. 11 corresponds substantially to the alternative illustrated in FIG. 9, reference herewith being made to the description of the latter.

Figure 11:
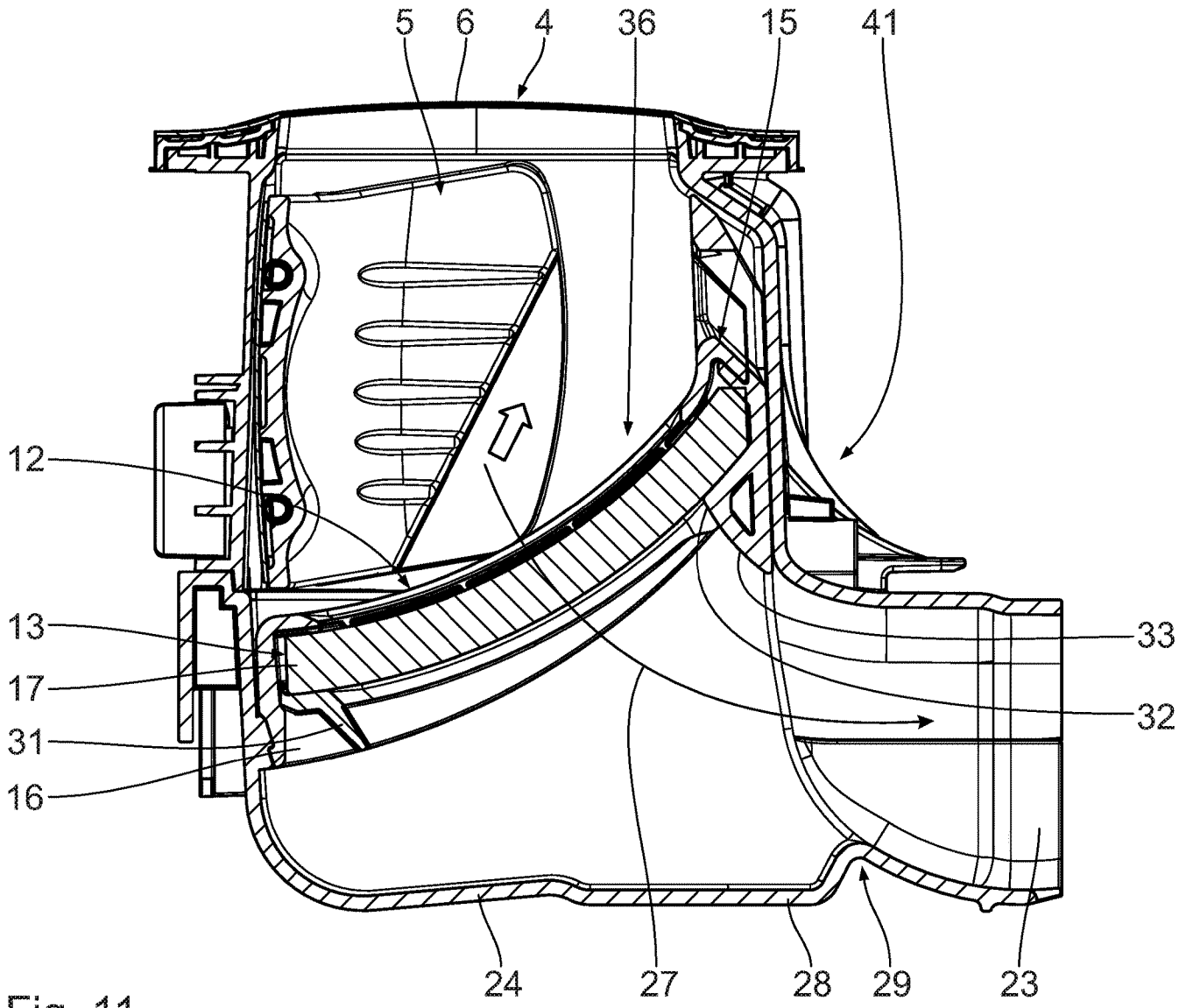
FIG. 11 is a view according to FIG. 8, having a further alternative of an insert for the downdraft ventilator.

In the case of the alternative illustrated in FIG. 11 the insert 12 comprises only the filter element 13 but no collection element 14. The filter element 13 bears directly on the collection tray 28.

The flow-directing element 32 is configured so as to be extended in such a manner that said flow-directing element 32 forms the transition to the duct 23 on the internal side of the flow. Said flow-directing element 32 is in particular configured in such a manner that said flow-directing element 32 also comprises the flow-directing face 33 which is a component part of the collection tray 21 in the case of the alternative according to FIG. 9.

It is possible for the base wall 24 of the collection tray 28 to be configured so as to be substantially planar also in the case of the alternatives illustrated in FIGS. 9 and 10. It is in particular possible for the base face 34 of the collection tray 21 to be configured in such a manner that the free end thereof in the region of the cooking vapors exit opening 22 bears on the cam 29 of the collection tray 28 so as to correspond to the alternative illustrated in FIG. 8. The base face 34 of the collection tray 21 can in particular bear in a substantially tight, in particular liquid-tight, manner on the cam 29. An ingress of liquid, in particular grease, into the region between the collection tray 21 and the collection tray 28 is prevented on account thereof.

The details of the various alternatives, in particular of the alternatives illustrated in FIGS. 8 to 11, can be combined with one another in a substantially free manner. In particular, the various alternatives of the filter element 13 and of the collection element 14 can be combined with one another in a substantially free manner.

Further details of the downdraft ventilator 4, in particular of the closure element 6 for closing the cooking vapors entry opening 5, will be described hereunder.

Figure 12:
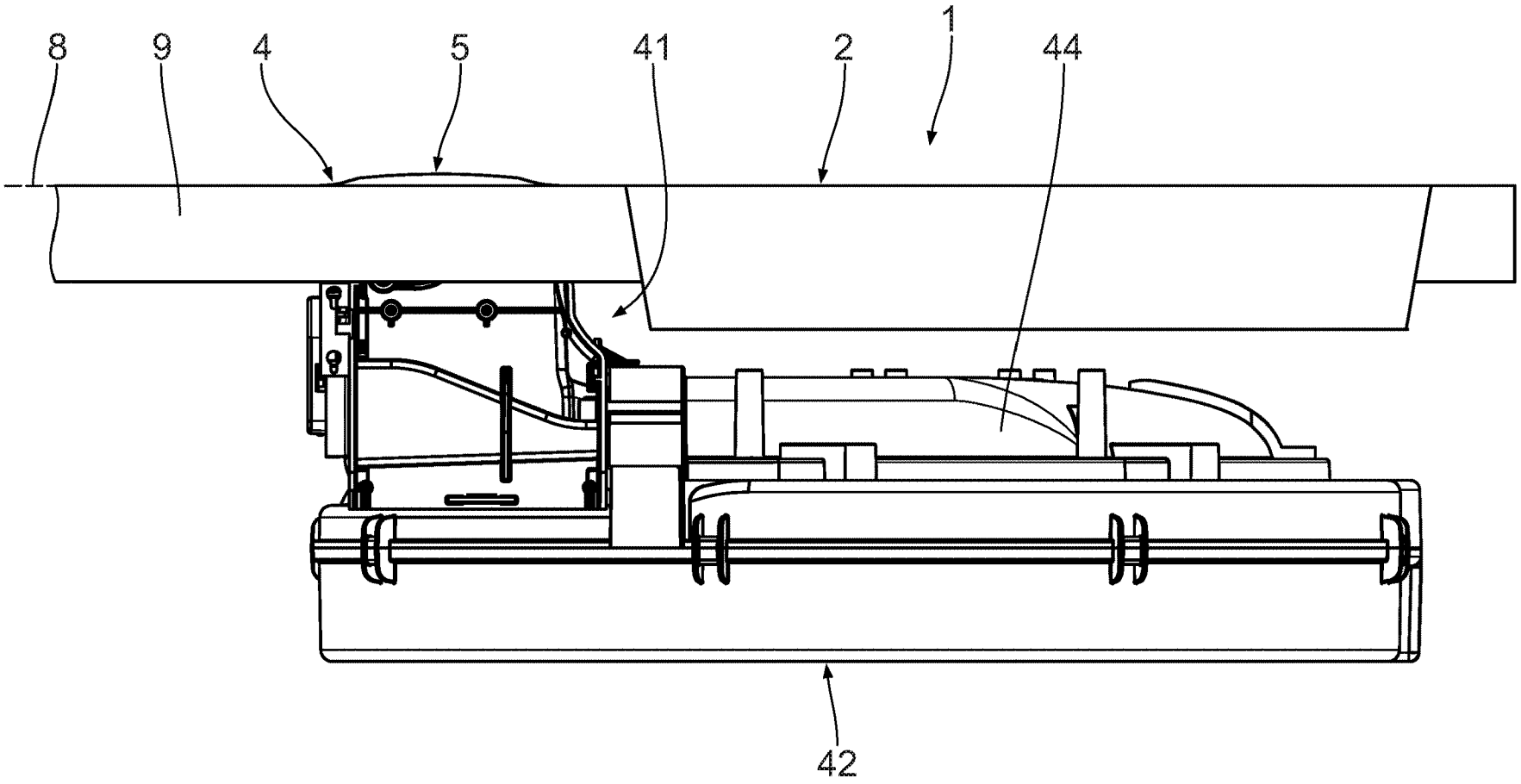
FIG. 12 is a schematic side view of a hob system integrated in a kitchen worktop, having a downdraft ventilator and a hob.
Figure 13:
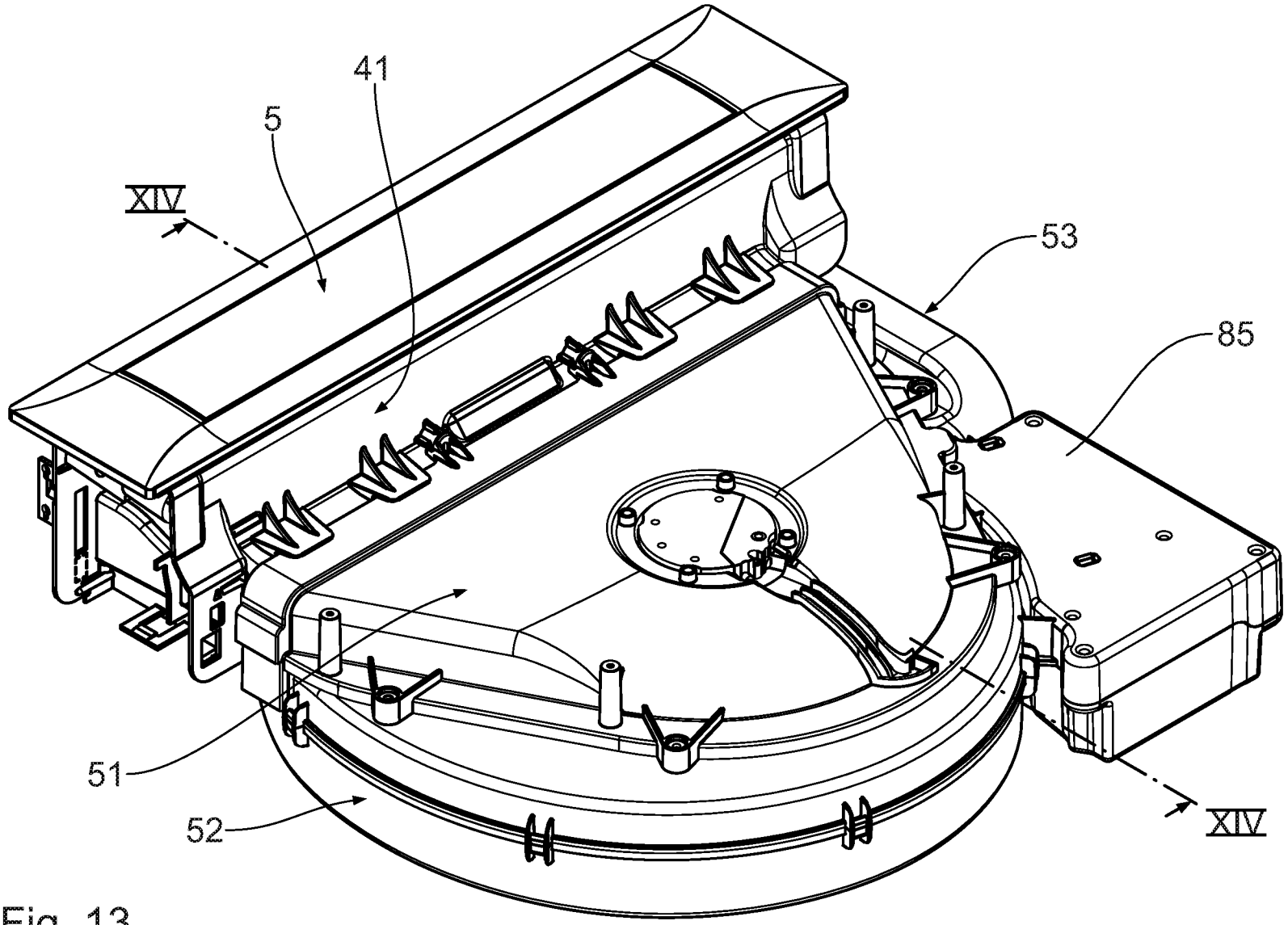
FIG. 13 is a perspective view of the downdraft ventilator according to FIG. 12.
Figure 14:
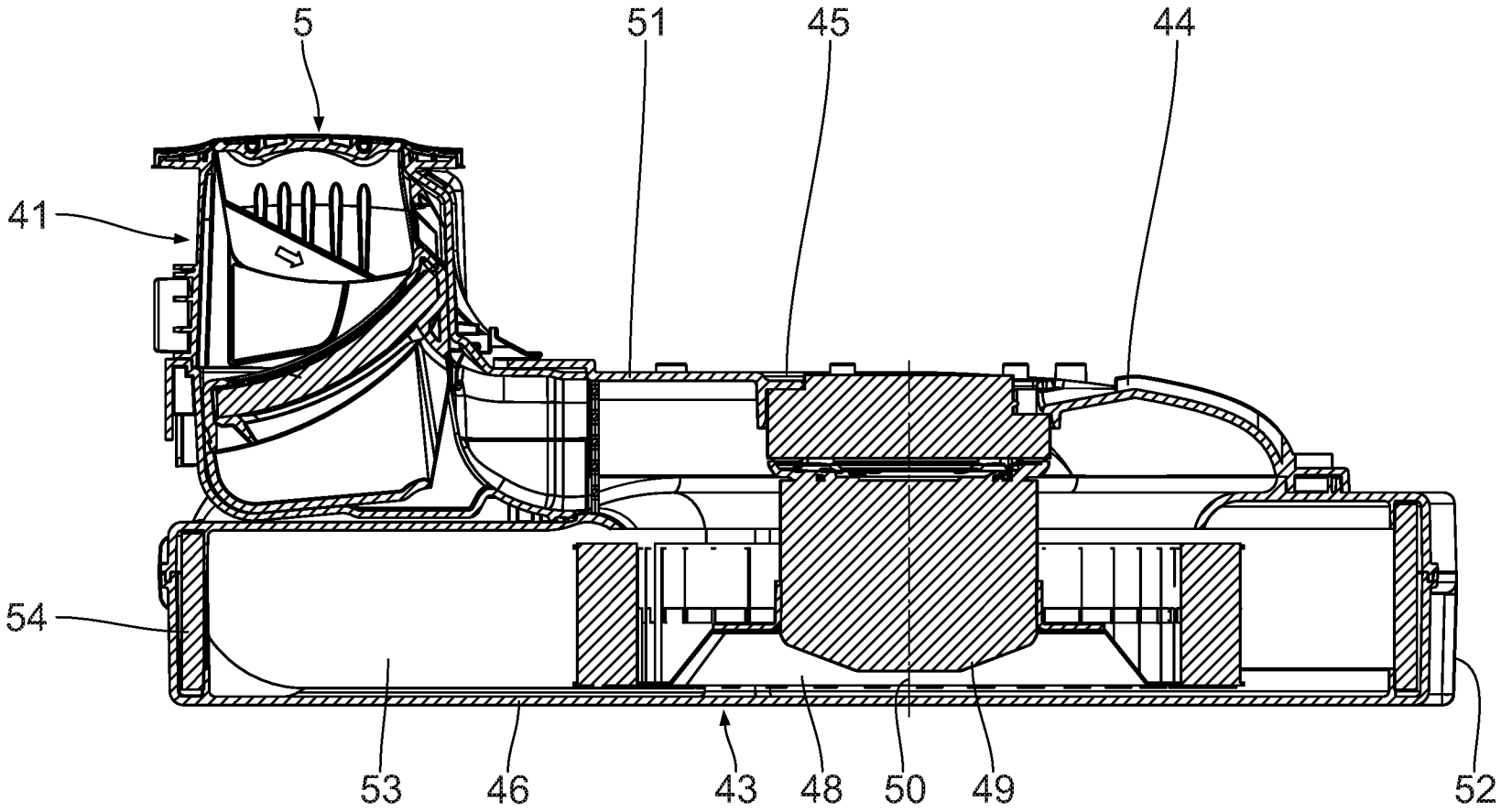
FIG. 14 is a schematic sectional view of the downdraft ventilator according to FIG. 13 along the line XIV-XIV.

For the sake of clarity, an assembly of the hob system 1 having the hob 2 and the downdraft ventilator 4 in the worktop 9 is once again illustrated in FIG. 12. Further views of the downdraft ventilator 4 are illustrated in FIGS. 13 and 14.

The downdraft ventilator 4 comprises a cooking vapors entry installation 41 having the cooking vapors entry opening 5. The cooking vapors entry installation 41 is inserted in a clearance in the worktop 9. The above-described insert 12 is insertable into the cooking vapors entry installation 41. The insert 12 can also be configured in an alternative manner. In principle, it is even possible for the insert 12 to be completely dispensed with.

The downdraft ventilator 4 furthermore comprises a suction installation 42 for suctioning cooking vapors through the cooking vapors entry installation 41. The suction installation 42 comprises a ventilator 43. The ventilator 43 is disposed in a ventilator housing 44. The ventilator housing 44 is configured in multiple parts. Said ventilator housing 44 comprises in particular a lid 45 and a base 46. The lid 45 and the base 46 are connected to one another, in particular releasably connected to one another, by means of fastening means, in particular in the form of fastening brackets 47. Screws, latching elements, or other fastening means can also be provided as fastening means.

The ventilator housing 44 is from plastics material. In principle, said ventilator housing 44 can also be from metal, in particular aluminum, or fiber-composite material, or from another material, or comprise regions from respective materials. In terms of respective details, reference is to be made to DE 10 2015 213 470.9, the entire contents of which are incorporated herein by reference.

Ventilator 43 comprises a ventilator rotor 48 which is driveable by means of a motor 49. The ventilator rotor 48 is in particular mounted so as to be rotatable about a vertically aligned rotation axis 50.

The motor 49 is in particular connected to the lid 45. Said motor 49 is particularly suspended on the lid 45. The motor 49 is in particular disposed so as to be spaced apart from the base 46 of the ventilator housing 44. The operational safety, in particular with a view to liquids potentially entering the ventilator housing 44, is improved on account thereof.

The lid 45 delimits an intake space 51. The intake space 51 in the flow direction is disposed between the cooking vapors entry installation 41 and the ventilator 43. Said intake space serves for the suctioning of cooking vapors by means of the ventilator 43. The suctioned cooking vapors are guided by way of a helical space 52 configured in the ventilator housing 44 to an exhaust opening 53.

A sound-insulating element, in particular in the form of an insulation mat 54, is disposed so as to encircle the helical space 52 along a side wall of the ventilator housing 44. In terms of details of the sound-insulating element reference is to be made to DE 10 2015 213 471.7, the entire contents of which are incorporated herein by reference.

The downdraft ventilator 4 in the vertical direction has an overall extent of at most 30 cm, in particular at most 25 cm, in particular at most 20 cm. Said downdraft ventilator 4 is thus configured so as to be very compact.

The downdraft ventilator 4 in the horizontal direction has an overall extent in the direction perpendicular to a longitudinal axis of the cooking vapors entry opening 5 of at most 60 cm, in particular at most 50 cm. This enables the hob system 1 to be configured so as to have an overall width of less than 100 cm, in particular less than 90 cm, in particular less than 80 cm. In principle, an overall width of less than 60 cm is also possible and installation of the hob system 1 in kitchen base cabinets of various standard dimensions is enabled on account thereof.

The downdraft ventilator 4 is thus in particular constructed in such a manner that the cooking vapors flow suctioned through the cooking vapors entry opening 5 is first suctioned downward through the cooking vapors entry opening 5 and is deflected toward the side in the cooking vapors entry installation 41. The cooking vapors flow from the cooking vapors entry installation 41 makes its way in a substantially horizontal direction into the intake space 51 of the ventilator 43. From there, said cooking vapors flow is suctioned downward by means of the ventilator 43 and conveyed by way of the helical space 52 to an exhaust opening 53. A further filter, in particular carbon filter or a plasma filter, can also be disposed ahead of the exhaust opening 53.

The exhaust opening 53 is in particular disposed in a plane which is perpendicular to the plane of the cooking vapors entry opening 5.

The exhaust opening 53 in the projection perpendicular to the plane defined by said exhaust opening 53 is in regions disposed directly below the cooking vapors entry opening 5.

It is also possible for the cooking vapors flow to be initially directed onward by way of a pipe/duct system. This can be advantageous in particular when there is only limited space in the region behind the kitchen base cabinet 11 in which the downdraft ventilator 4 is disposed, or when the cooking vapors flow is to be directed to the outside, in particular in the case of an exhaust air system. It can also be advantageous in the case of a recirculating air system for the filtered cooking vapors flow not to be exhausted directly through the exhaust opening 53 but to be initially directed onward by way of a pipe/duct system, for example in a pedestal region of the kitchen base cabinet 11.

According to one advantageous alternative the ventilator housing 44 is releasably connected to the cooking vapors entry installation 41. It is furthermore possible for the ventilator 43 to be provided in two variants that are configured so as to be mutually mirror symmetrical. In this case the side toward which the cooking vapors flow is deflected downward in the cooking vapors entry installation 41 can be freely chosen. The flexibility by way of which the downdraft ventilator 4 is adaptable to constructive situations is further improved on account thereof.

The ventilator housing 44 is disposed so as to be spaced apart from the worktop 9. A spacing of at least 5 cm exists in the vertical direction between the lid 45 and the cooking vapors entry opening 5. The spacing between the lid 45 and the cooking vapors entry opening 5 is in particular so large that sufficient space remains for the installation of the hob 2 in the worktop 9. The ventilator housing 44 in the installed state is disposed so as to be spaced apart from the hob 2. A circulation of air between the ventilator housing 44 and the hob 2 is in particular enabled on account thereof.

According to one alternative it can also be provided for the ventilator housing 44 to be mechanically connected to the hob 2 or an installation/holding frame for the hob 2. The assembly of the hob system 1 can be facilitated on account thereof. The hob system 1 can in particular be preassembled ex works. Said hob system 1 in this case has only to be inserted into a matching clearance in the worktop 9. Retrofitting the hob system 1 in existing worktops 9 is facilitated on account thereof.

The cooking vapors entry installation 41 in the region of the cooking vapors entry opening 5 has a width of at most 20 cm. The width of the cooking vapors entry installation 41 in the region of the cooking vapors entry opening 5 is in particular at most 15 cm, in particular at most 10 cm, in particular at most 8 cm, in particular at most 5 cm.

For a flexible installation of the downdraft ventilator 4 the cooking vapors entry installation 41 can be provided with an installation frame (not illustrated in the figures). The installation frame is adaptable in particular in terms of the width and/or depth thereof. On account thereof, it is possible for the downdraft ventilator 4 to be combined with substantially arbitrary, in particular already existing, hobs 2. The downdraft ventilator 4 can in particular be combined with hobs 2 of various manufacturers.

The downdraft ventilator 4 can in particular be configured as a compact module having a low installation height. The ease of installation of said downdraft ventilator 4 is in particular not dependent on any potentially existing or non-existent available space in the pedestal region of the kitchen base cabinet 11.

Details of the closure element 6, in particular of the repositioning ability thereof for opening and closing the cooking vapors entry opening 5, will be described hereunder with reference to FIGS. 15A to 19C.

Figure 15A:
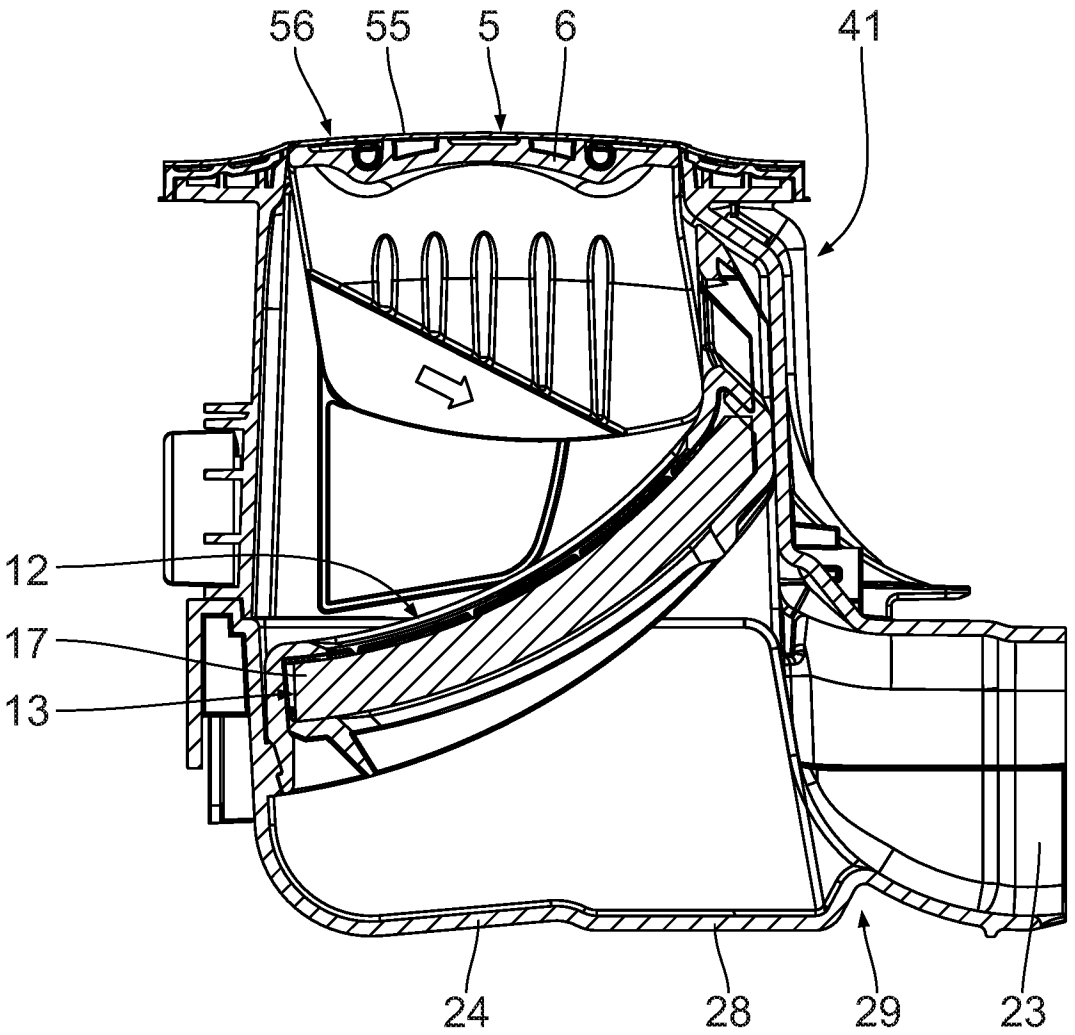
FIG. 15A is a sectional view of a fragment of a downdraft ventilator in the region of an inflow installation in the closed state of an inflow opening.
Figure 15C:
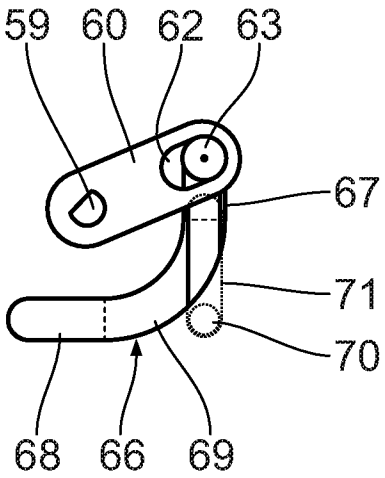
FIG. 15C is an isolated illustration of the guide elements for guiding the closure element in a position according to FIG. 15B.

The closure element in FIG. 15A is illustrated in a first position that closes the cooking vapors entry opening 5. The closure element 6 in this position closes the cooking vapors entry opening 5 in particular in a tight, in particular liquid-tight, in particular gas-tight, manner.

The closure element 6 in the variant illustrated in FIGS. 15A to 19C has a slightly curved, in particular a slightly outwardly bulged, surface 55. A draining of liquids is facilitated on account thereof.

The closure element 6 is in particular from metal, in particular from aluminum or steel, in particular stainless steel. The surface 55 can in particular be configured so as to be brushed. In principle, the closure element 6 can also be from plastics material, a fiber-composite material, in particular having carbon fibers, from glass, or another material.

The closure element 6 in regions can also be configured from dissimilar materials. Said closure element 6 can in particular be configured in two or more parts.

The closure element 6 comprises in particular a closure flap 56 by means of which the cooking vapors entry opening 5 is closable. The closure flap 56 in turn can be configured in one or more parts. Said closure flap 56 can be subdivided into in each case two or more separable part-regions in particular in the longitudinal and/or transverse direction.

The closure flap 56 is mechanically connected to lateral holding elements 57. Said closure flap 56 is connected in particular in a force-fitting manner, in particular a form-fitting manner, to the lateral holding elements 57. Said closure flap 56 can also be configured so as to be integral to the lateral holding elements 57. The lateral holding elements 57 can also be from another material than the closure flap 56. The lateral holding elements 57 can in particular be from plastics material or metal, in particular aluminum or steel, in particular stainless steel.

Figure 20A:
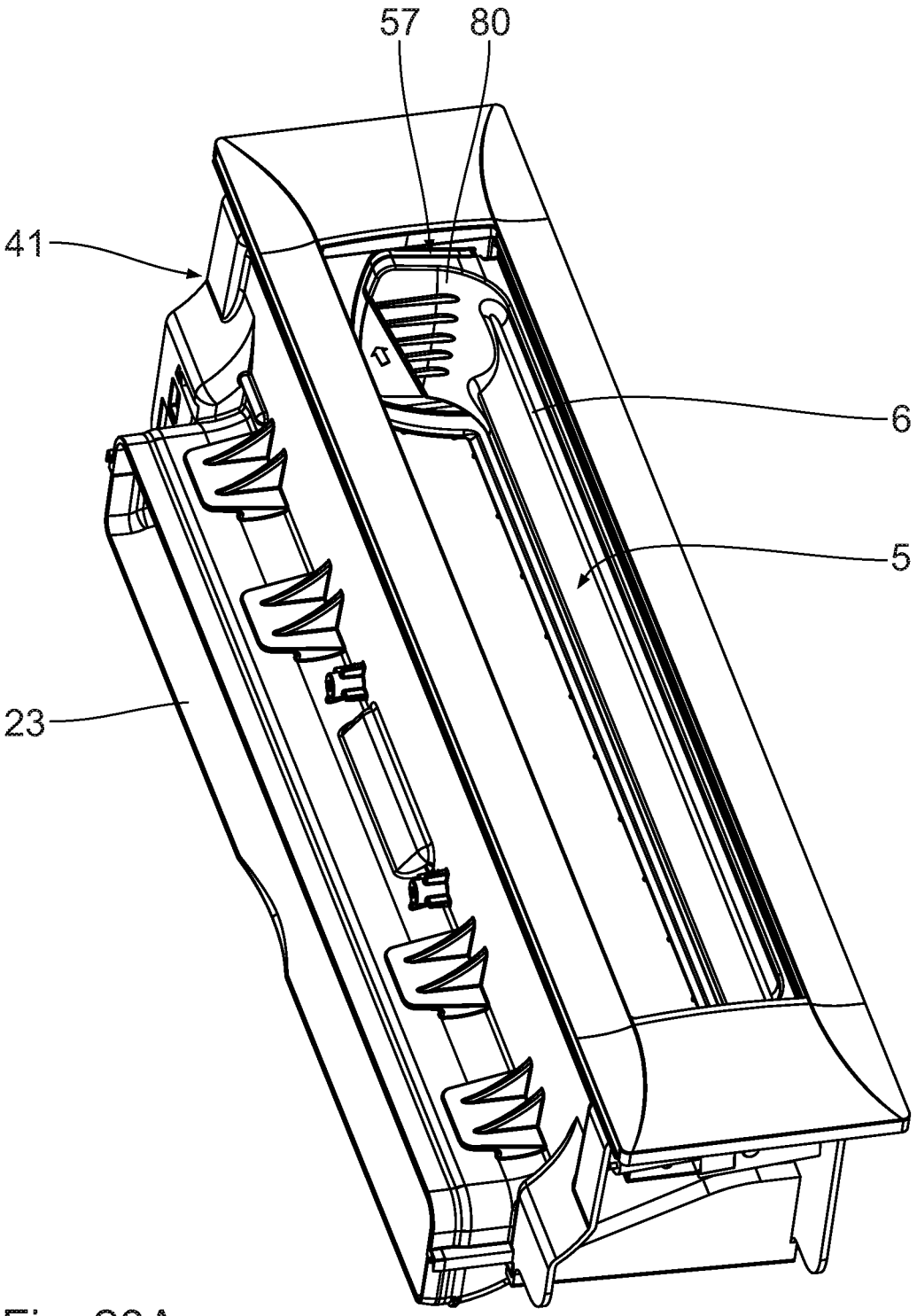
FIG. 20A is a plan view through the cooking vapors entry opening onto the closure element in the position according to FIG. 19A.
Figure 20B:
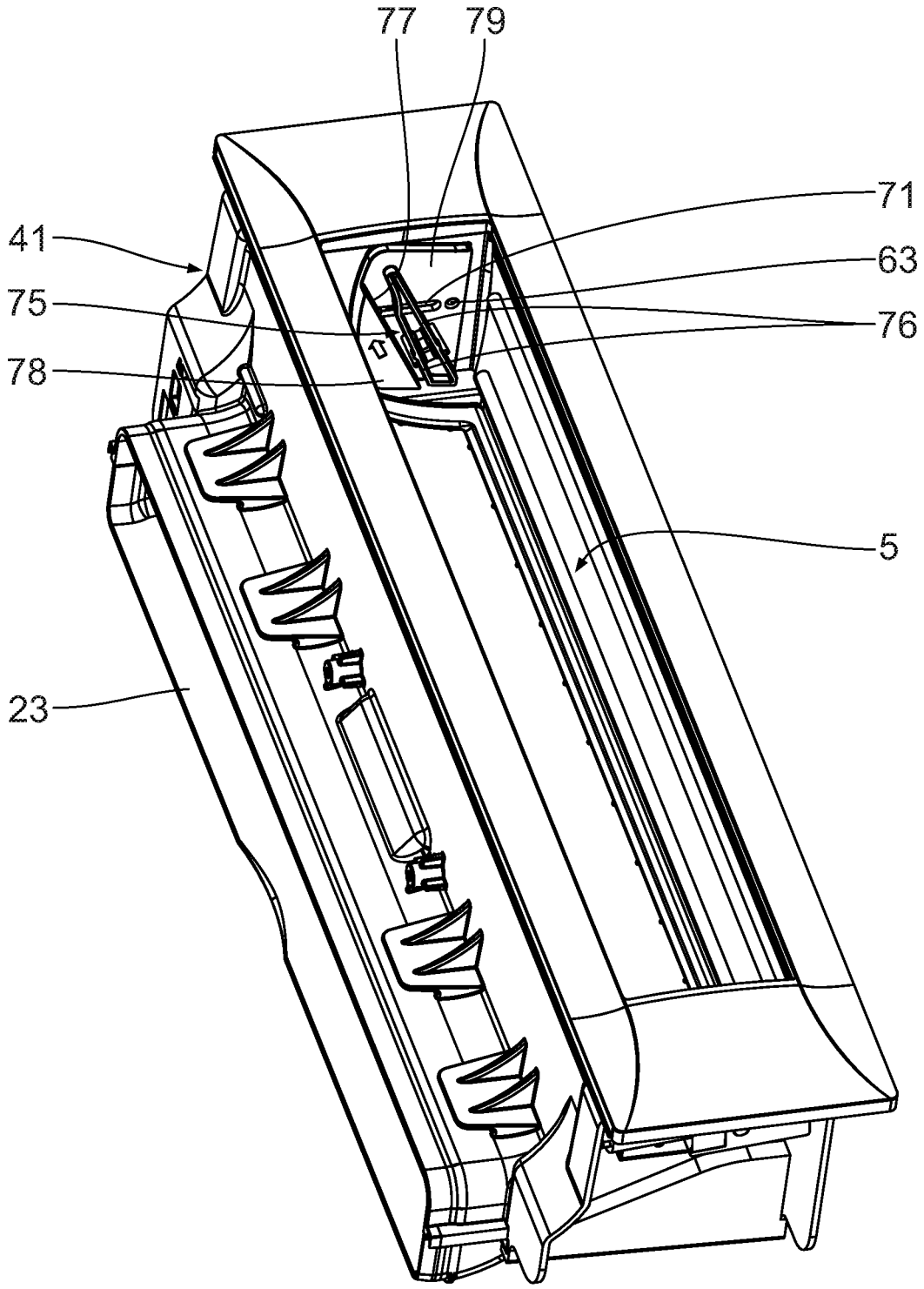
FIG. 20B is a view according to FIG. 20A with the closure element retrieved, such that the positional guiding of said closure element is visible.

As is illustrated in an exemplary manner in FIGS. 20A and 20B, the lateral holding elements 57 are in each case configured so as to be two-tiered. Said holding elements 57 have in particular in each case an external tier 79 which remains in the cooking vapors entry installation 41 even in the case of the removal of the closure flap 56 from the cooking vapors entry installation 41 (cf. FIG. 20B).

Said holding elements 57 moreover comprise an internal tier 80 which is configured so as to be force-fitting, in particular form-fitting, in particular integral to the closure flap 56, to the closure flap 56.

The closure element 6 in the terminal position that closes the cooking vapors entry opening 5 lies so as to be substantially completely below the upper boundary 58 of the cooking vapors entry installation 41. If at all, said closure element 6, by virtue of the bulged configuration thereof, in the central region projects by at maximum a few millimeters beyond the upper boundary 58 of the cooking vapors entry installation 41.

The closure element 6 is retrievable from the downdraft ventilator 4. Said closure element 6 is retrievable from the cooking vapors entry installation 41 in particular through the cooking vapors entry opening 5. The cleaning of the closure element 6 is facilitated on account thereof, for example. Moreover, the access to component parts of the downdraft ventilator 4 below the cooking vapors entry opening 5 is facilitated on account thereof.

The closure element 6 is in particular configured so as to be asymmetrical in such a manner that said closure element 6 is insertable into the cooking vapors entry installation 41 only in a single orientation. It can be prevented on account thereof that the closure element 6 is inserted into the cooking vapors entry installation 41 so as to be rotated out of position by 180°.

The closure element 6 is repositionable by means of an activation installation. Said closure element 6 by means of the activation installation is in particular repositionable in a reversible manner from the first position that closes the cooking vapors entry opening 5 to a second position that unblocks the cooking vapors entry opening 5 (cf. Film 19A). The repositioning installation comprises a motor (not illustrated in the figures), in particular an actuator. Said repositioning installation can also comprise a plurality of motors.

The motor forms in particular a purely rotary drive by means of which the closure element 6 is repositionable.

The motor by way of the force transmission element, in particular in the form of a motor shaft 59, is connected to a force transmission lever 60 in a force-transmitting manner. The motor shaft 59 is in particular connected to the force transmission lever 60 in a form-fitting manner. Said motor shaft 59 to this end has in particular a rotationally asymmetrical end piece.

The force transmission lever 60 is disposed on the external side of a lateral delimitation wall 61 by means of which a cooking vapors inflow region 62 is laterally delimited.

A clearance, in particular in the form of an elongate hole 62, for receiving a first guide slide block 63 is provided in the force transmission lever 60. The elongate hole 62 can be surrounded by an encircling web in order for the force transmission lever 60 to be reinforced.

The first guide slide block 63 is fixedly connected to one of the lateral holding elements 57 of the closure element 6.

The first guide slide block 63 can comprise an external region, in particular in the form of a hollow cylinder 65, that is mounted so as to be rotatable on a central pin 64.

A first guide slot 66 is provided for guiding the first guide slide block 63 in the activation of the force transmission lever 60 by means of the motor. The first guide slot 66 is configured in the lateral delimitation wall 61.

The first guide slot 66 on the end side has in each case one straight end region 67, 68. The straight end regions 67, 68 are connected to one another by an arcuate central region 69 which in particular is in the shape of an arc segment. The central region 69 comprises in particular an arc segment of 90°, that is to say a quadrant.

The motor shaft 59 relative to the guide slot 66 is disposed such that the spacing of said motor shaft 59 from the end regions 67, 68 is somewhat smaller than the spacing of said motor shaft 59 from the central region 69. In the case of a repositioning of the force transmission lever 60 by means of the motor shaft 59 the first guide slide block 63 is therefore repositioned not only in the first guide slot 66 but simultaneously also in the elongate hole 62 of the force transmission lever 60 along the longitudinal axis of the force transmission lever 60.

The repositioning installation moreover comprises a second guide slide block 70 which is guided in the second guide slot 71. The second guide slide block 70 is connected to the lateral delimitation wall 61 in a locationally fixed manner. Said second guide slide block 70 is in particular disposed on the internal side of the lateral delimitation wall 61 that faces the flow region.

The second guide slide block 70 is in particular disposed in that region of the first guide slot 66 that is on the external side of the curve.

The first guide slot 66 is in particular configured so as to be mirror symmetrical with an axis that runs through the motor shaft 59 and the second guide slide block 70.

The second guide slot 71 is configured in the lateral holding element 57. Said second guide slot 71 is in particular configured so as to be straight. Said second guide slot 71 is in particular aligned so as to be substantially perpendicular to an alignment of the closure flap 56.

The second guide slot 71 is repositioned in the case of a repositioning of the closure element 6. Said second guide slot 71 is in particular displaced and rotated out of position relative to the second guide slide block 70.

The second guide slot 71 in the first terminal position of the closure element 6 is aligned so as to be parallel with the vertical direction.

The second guide slot 71 in the second terminal position of the closure element 6 is aligned so as to be parallel with the horizontal direction.

By virtue of the guiding of the closure element 6 in the repositioning of said closure element 6 with the aid of the motor shaft 59, the closure element 6 by virtue of the configuration and disposal of the guide slide blocks 63, 70 and of the guide slots 66, 71 initially carries out a linear movement, thereafter a rotary movement, and subsequently once again a linear movement. In general, the guides in the form of slotted links for guiding the repositioning of the closure element 6 are configured in such a manner that the closure element 6 in the repositioning between the two terminal positions thereof has at least two movement components which are linearly independent, in particular at least one linear and one rotary movement component, in particular two or more linear movement components.

The cooking vapors entry opening 5 in the operation of the downdraft ventilator 4 remains disposed so as to be locationally fixed in relation to the worktop 9.

In order for the motion sequence of the closure element 6 in the repositioning from the first terminal position to the second terminal position to be highlighted, views of the closure element 6 out of the flow region of the cooking vapors flow (part-figures A), positions of the force transmission lever 60 corresponding thereto and associated therewith the position of the first guide slide block 63 in the first guide slot 66 seen from the external side of the lateral delimitation wall 61 (part-figures B), and the positions of the guide slide blocks 63, 70 in the guide slots 66, 71 that correspond to the respective repositioning positions (part-figures C) in a schematic manner are in each case illustrated in FIGS. 15 to 19.

Figure 15B:
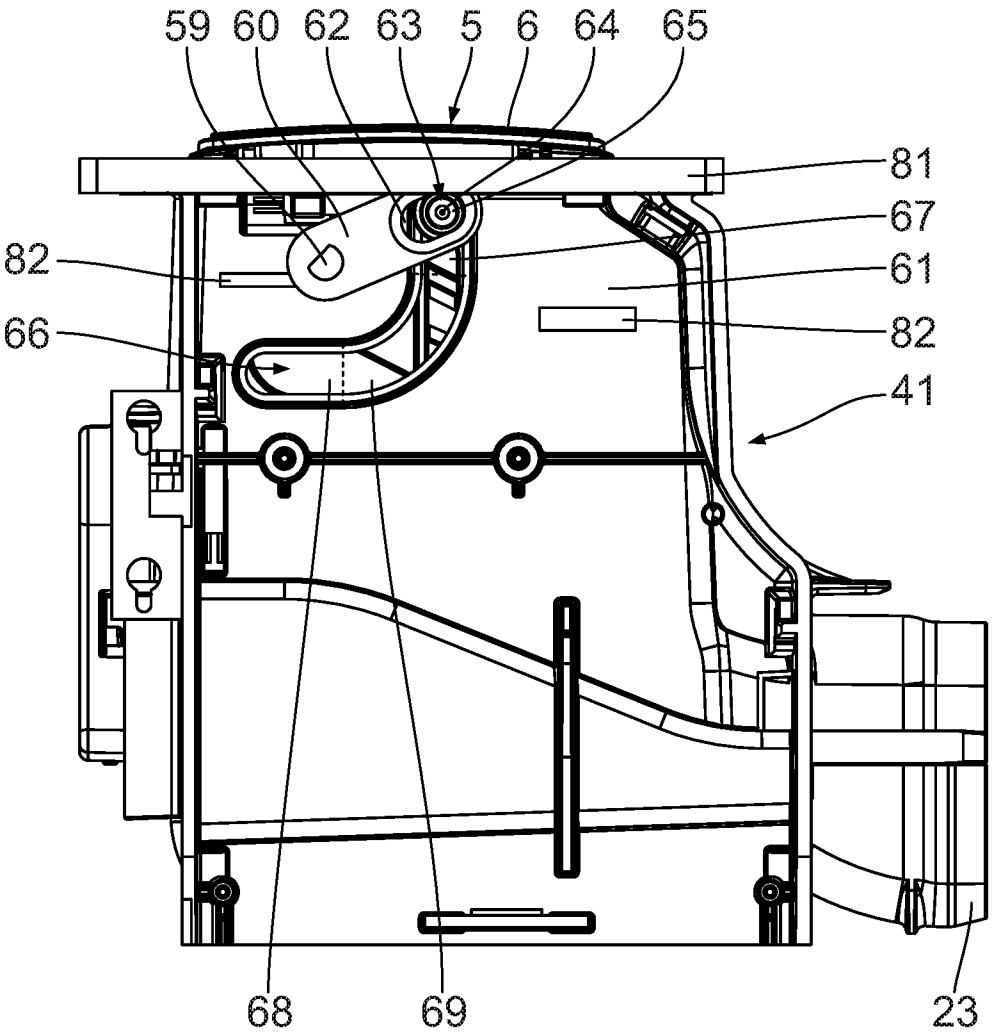
FIG. 15B is a rear view of the fragment according to FIG. 15A, said rear view being mirrored on a vertical axis.
Figure 16A:
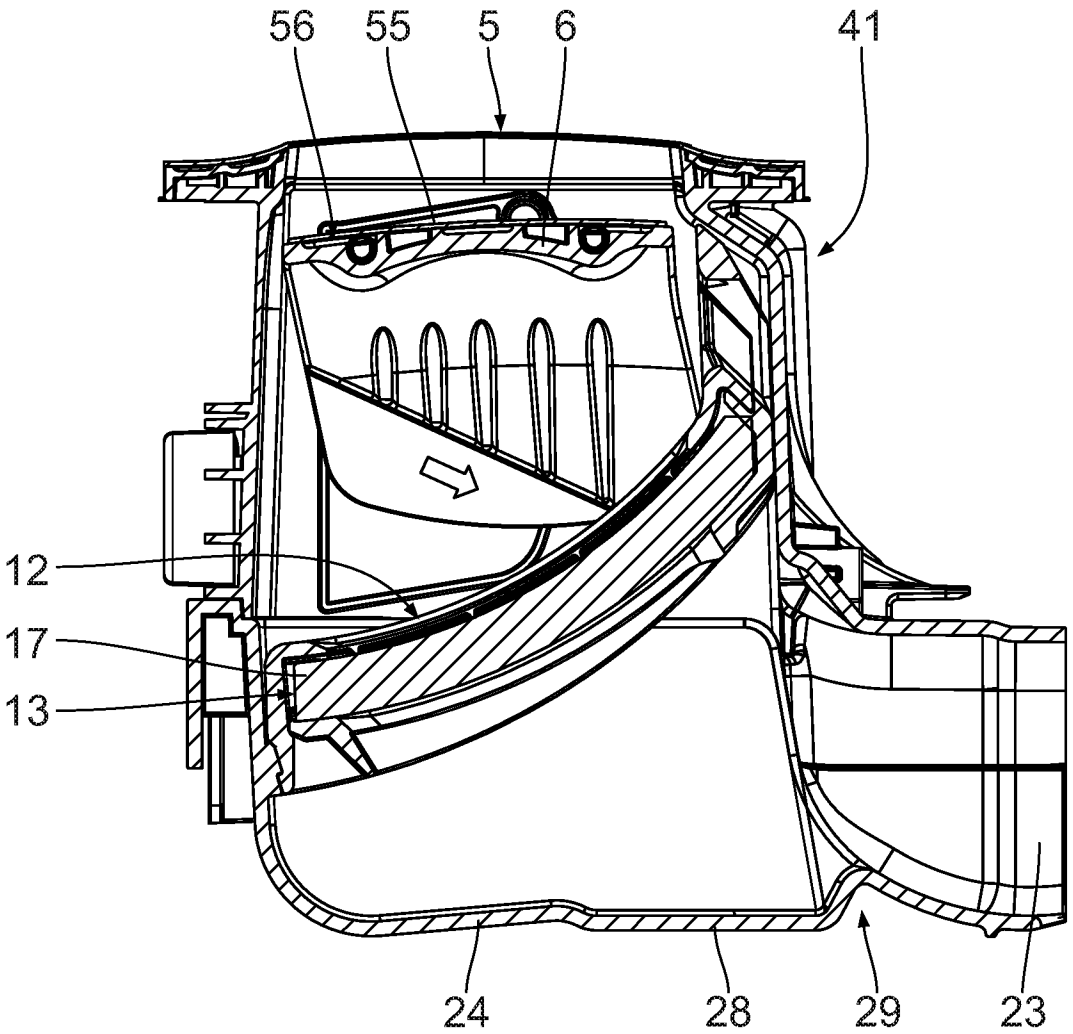
FIG. 16A is a view according to FIG. 15A in the opening procedure of the cooking vapors entry opening, having a position of the closure element in which alinear repositioning of said closure element is converted to a rotary movement, or in the closing procedure of the entry opening a rotary movement is conversely converted to a linear movement.
Figure 16C:
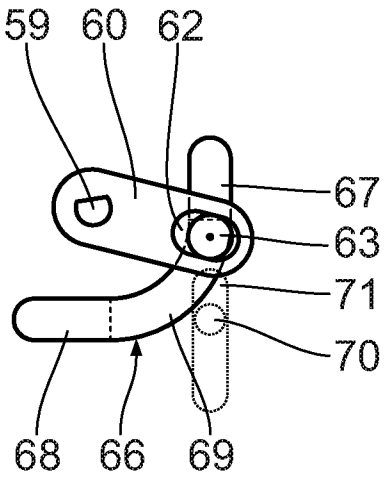
FIG. 16C is a view according to FIG. 15C in the opening procedure of the cooking vapors entry opening, having a position of the closure element in which a linear repositioning of said closure element is converted to a rotary movement, or in the closing procedure of the entry opening a rotary movement is conversely converted to a linear movement.
Figure 16B:
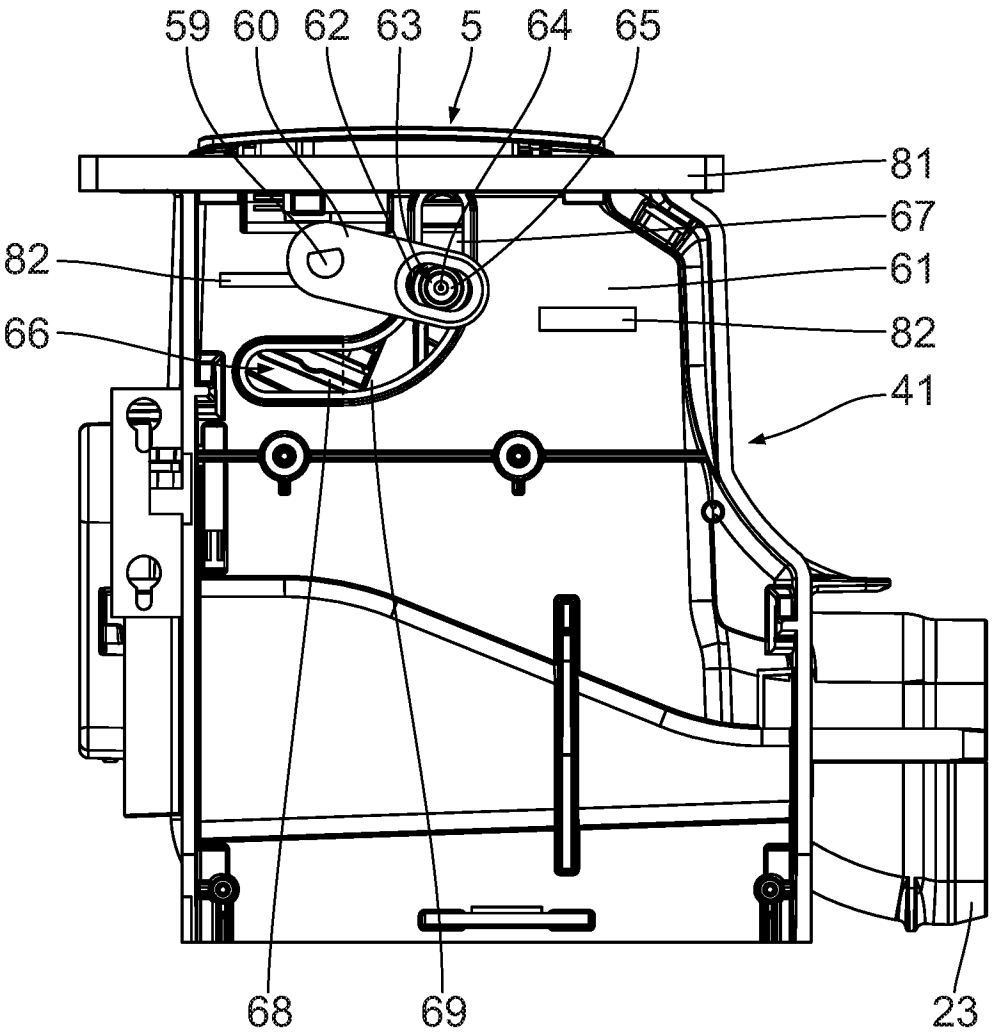
FIG. 16B is a view according to FIG. 15B in the opening procedure of the cooking vapors entry opening, having a position of the closure element in which a linear repositioning of said closure element is converted to a rotary movement, or in the closing procedure of the entry opening a rotary movement is conversely converted to a linear movement.
Figure 17A:
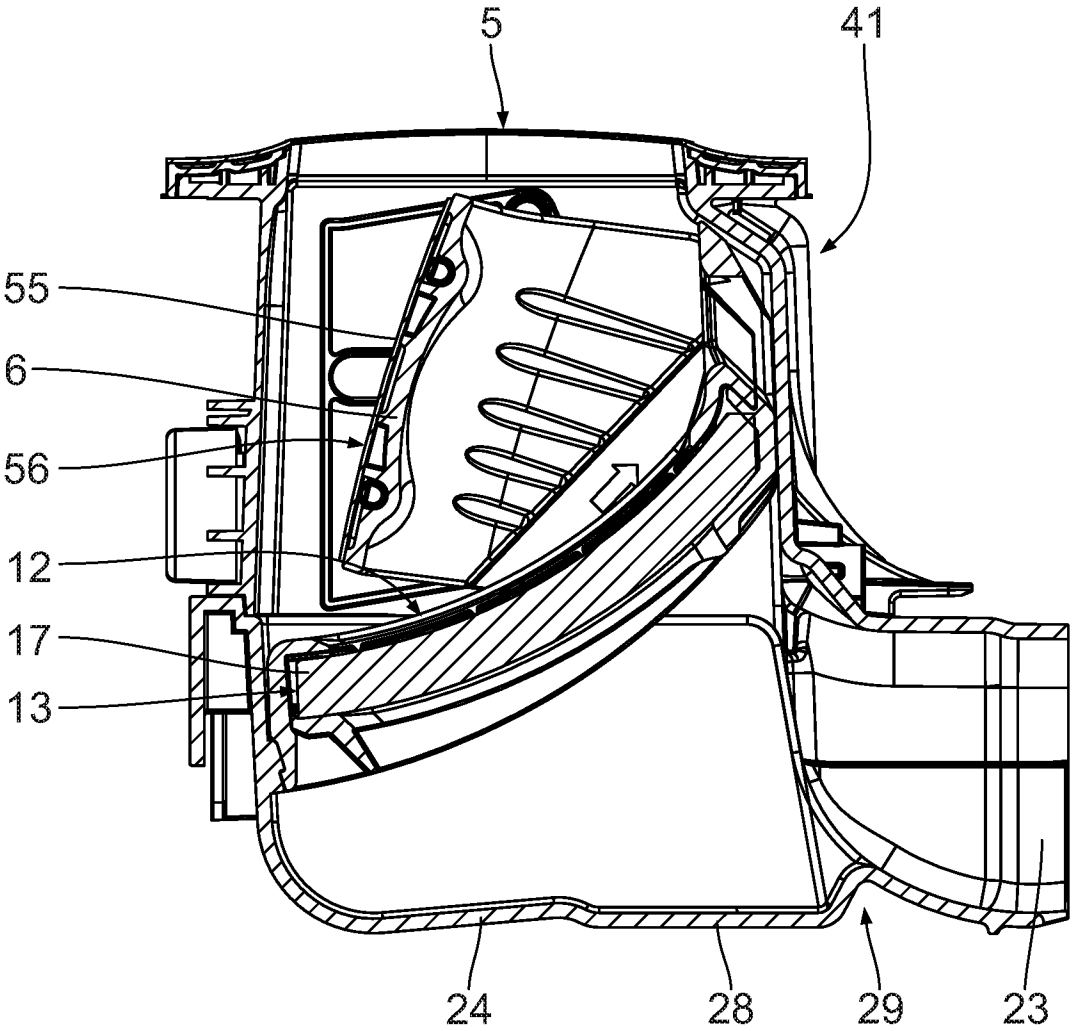
FIG. 17A is a view according to FIG. 15A with a different position of the closure element.
Figure 17C:
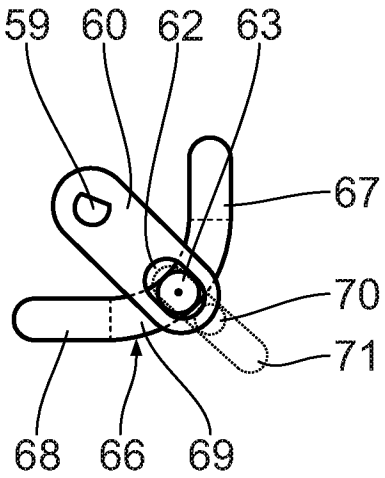
FIG. 17C is a view according to FIG. 17C in a central position of the closure element.
Figure 17B:
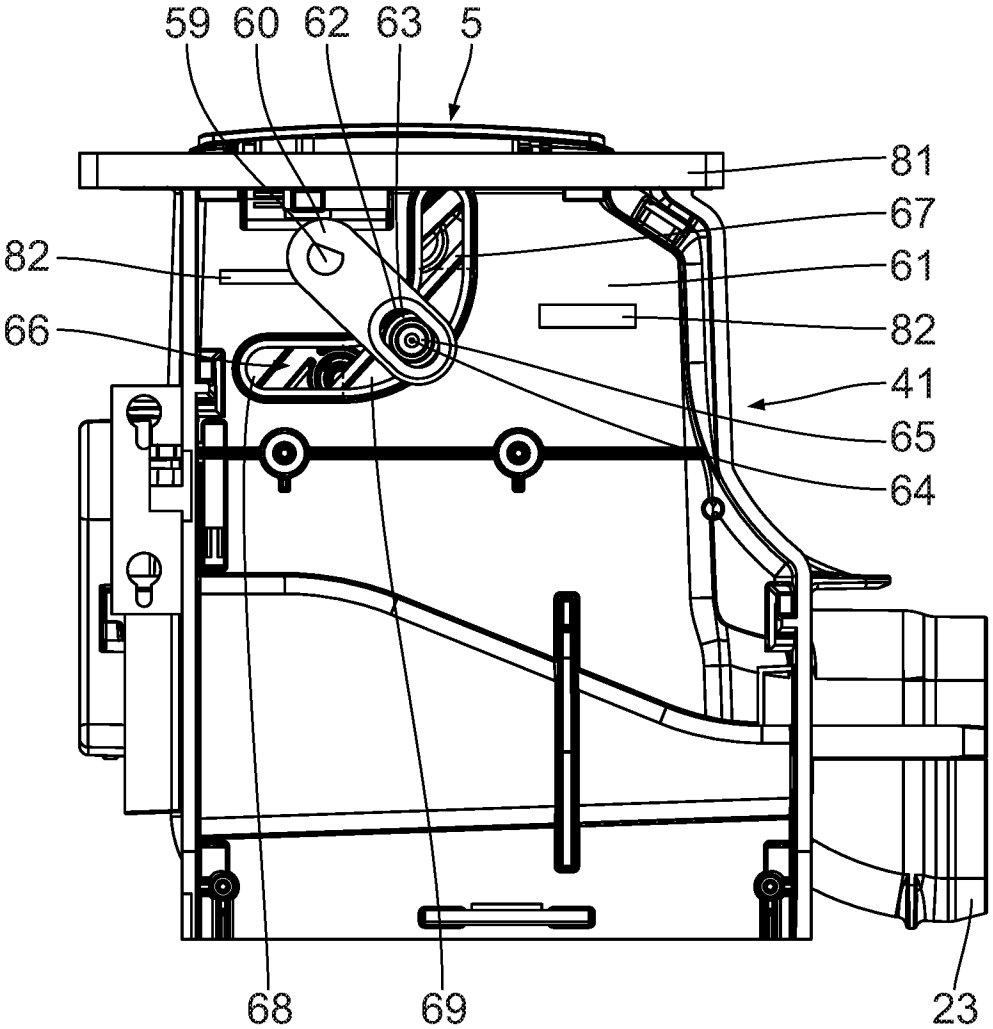
FIG. 17B is a view according to FIG. 15B with a different position of the closure element.
Figure 18A:
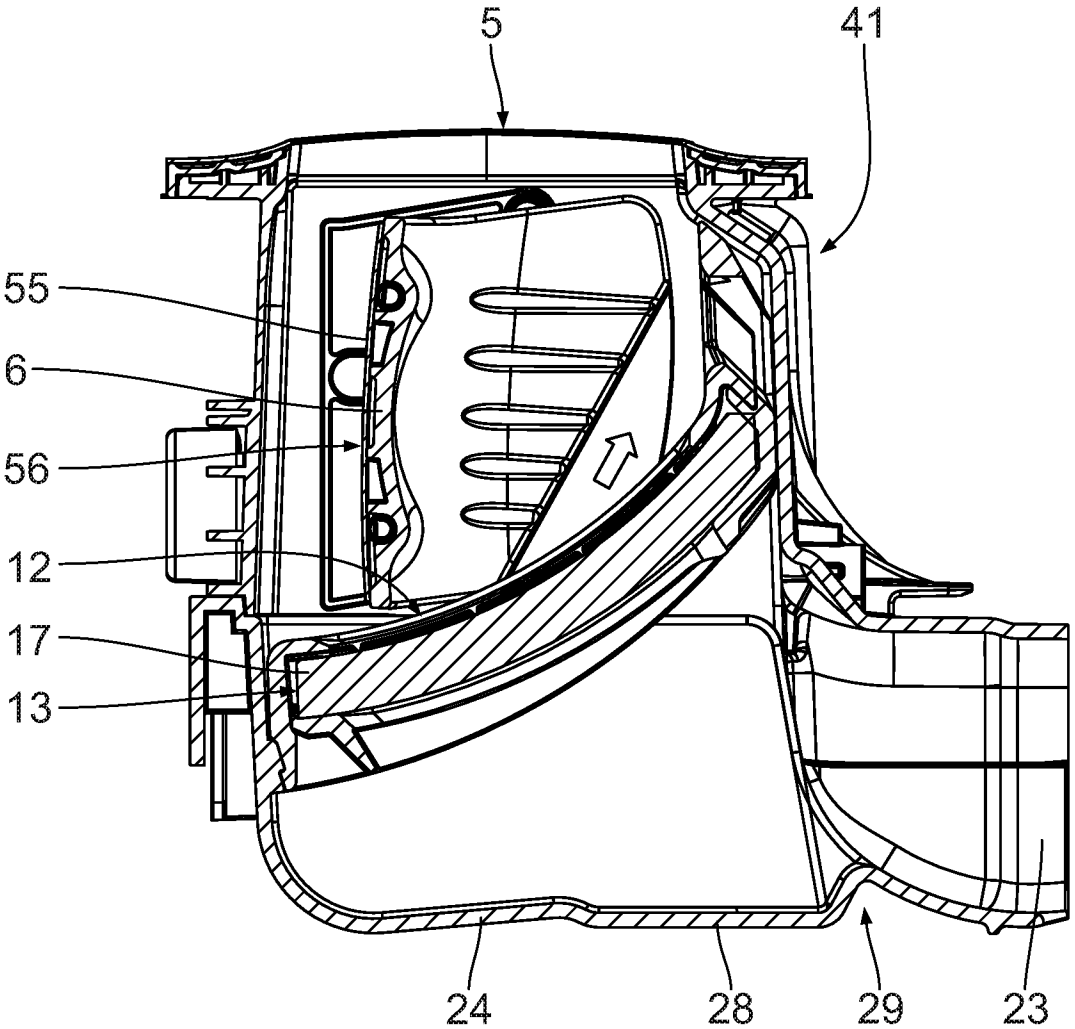
FIG. 18A is a view according to FIG. 15A, having the closure element in a position just prior to reaching the second terminal position in which the cooking vapors entry opening is opened.
Figure 18C:
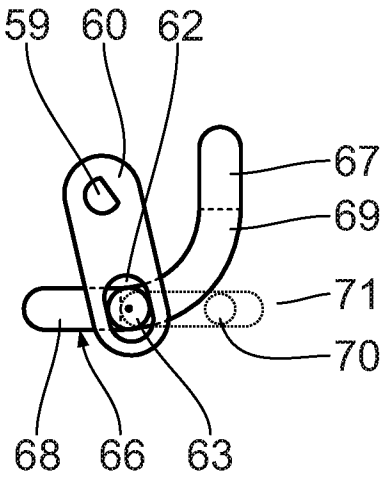
FIG. 18C is a view according to FIG. 15C, having the closure element in a position just prior to reaching the second terminal position in which the cooking vapors entry opening is opened.
Figure 18B:
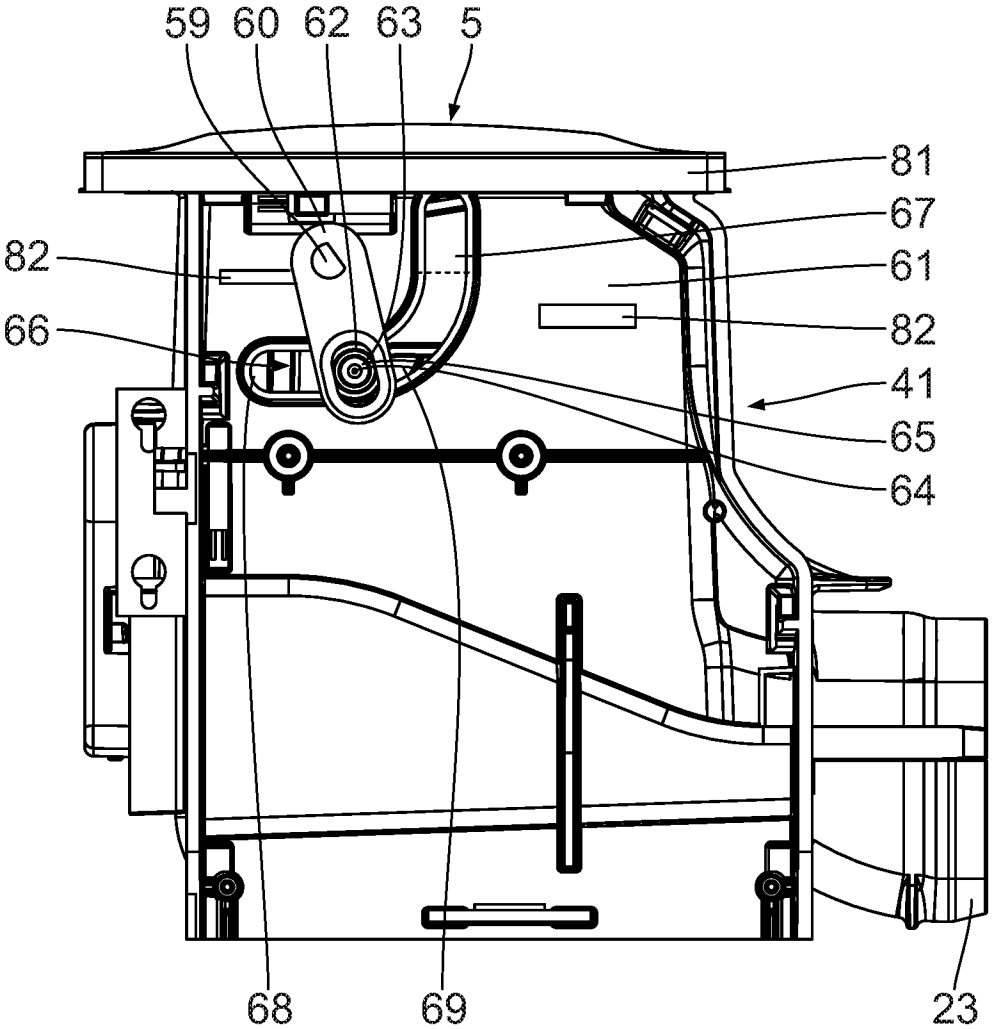
FIG. 18B is a view according to FIG. 15B, having the closure element in a position just prior to reaching the second terminal position in which the cooking vapors entry opening is opened.

As can be derived from FIGS. 15 to 19 in qualitative terms, the closure element 6 in the repositioning from the first position that closes the cooking vapors entry opening 5 initially carries out a purely linear movement, in particular a displacement in a vertically downward manner, that is to say into the cooking vapors inflow region (cf. FIG. 16A). An at least primarily rotary movement, that is to say a pivoting of the closure element 6 (cf. FIG. 17A) adjoins the linear movement. In turn, the latter is adjoined by a primarily linear repositioning that is preferably purely linear in the end region, in particular in the horizontal direction (cf. FIGS. 18A, 19A).

The closure element 6, in particular the closure flap 56, in the second terminal position is disposed so as to be substantially completely outside a flow region 72 of the cooking vapors.

The closure element 6, in particular in the second terminal position that unblocks the cooking vapors entry opening 5, is disposed so as to be completely below the cooking vapors entry opening 5, in particular completely below the hob plane 8.

The closure element 6, in particular by means of the linear repositioning in the horizontal direction toward the end of the repositioning procedure to the second terminal position, can be repositioned so as to be completely out of the flow region 72. In order for the closure element 6 to be received outside the flow region 72, the cooking vapors entry installation 41 has a cross section which, proceeding from the cooking vapors entry opening 5, widens in the inflow direction 73.

Figure 19A:
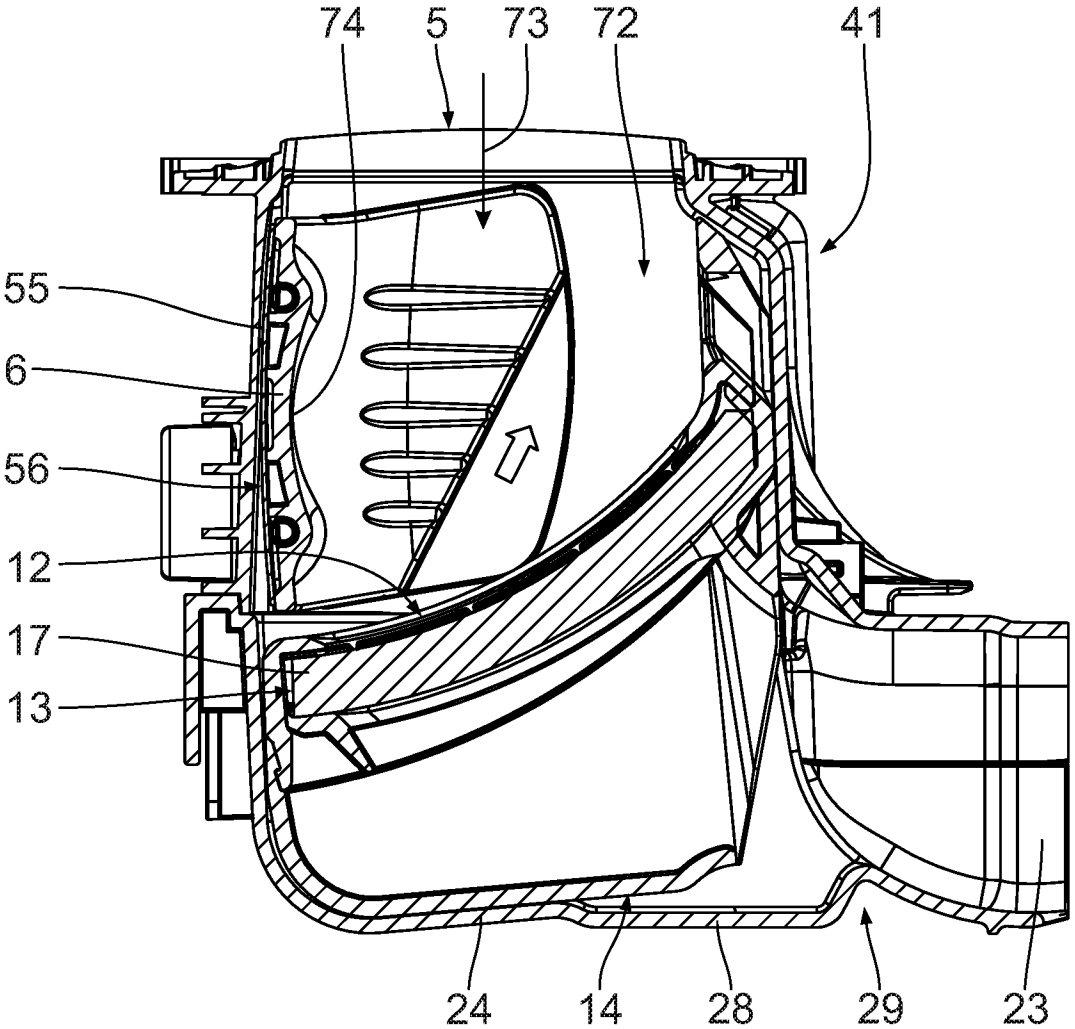
FIG. 19A is a view according to FIG. 15A, having the closure element in the second terminal position in which the cooking vapors entry opening is opened.
Figure 19C:
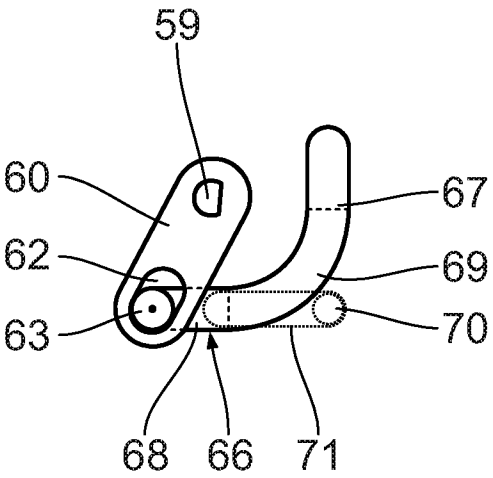
FIG. 19C is a view according to FIG. 15C, having the closure element in the second terminal position in which the cooking vapors entry opening is opened.
Figure 19B:
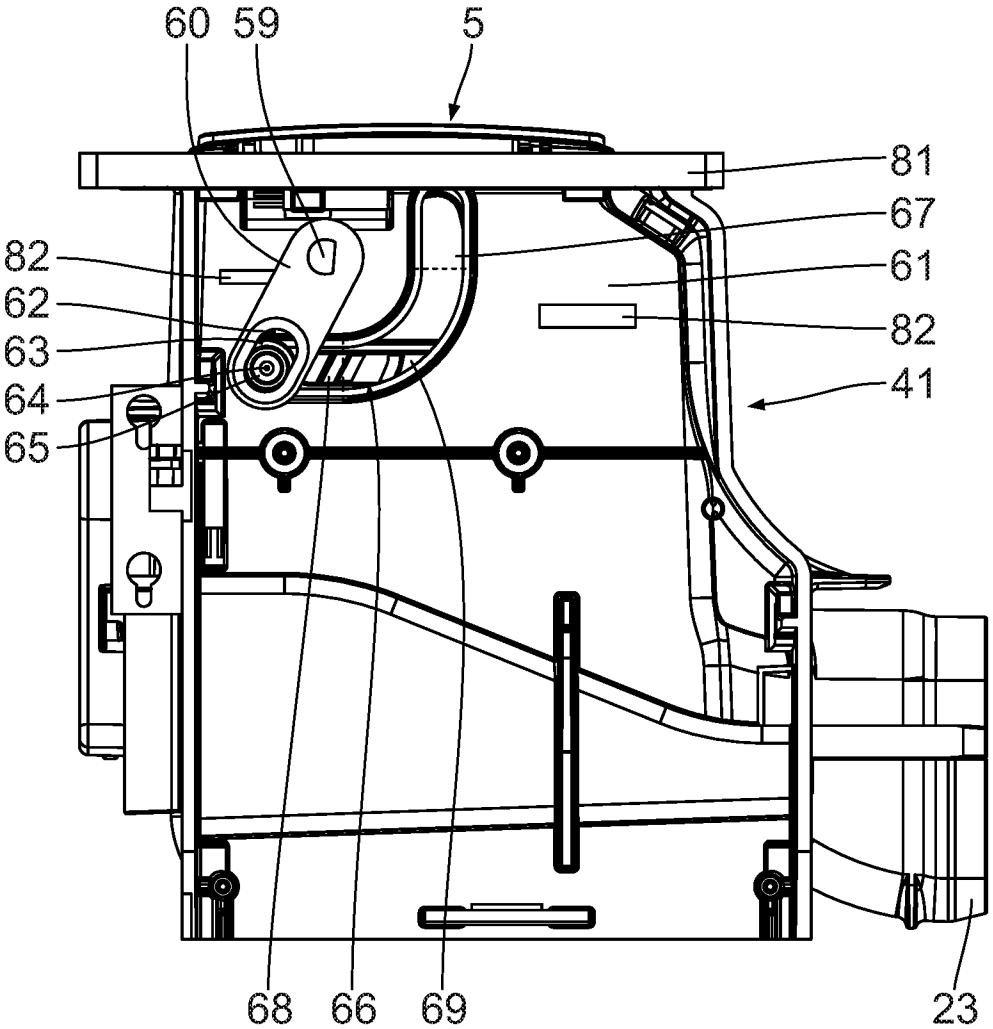
FIG. 19B is a view according to FIG. 15B, having the closure element in the second terminal position in which the cooking vapors entry opening is opened.

As can be seen, for example from FIG. 19A, the internal side 74 of the closure flap 56 in the second position of the closure element 6 that unblocks the cooking vapors entry opening 5 can form a delimitation face for delimiting the flow region 72. According to one advantageous alternative it can be provided for the internal side 74 of the closure flap 56 to be used as a flow-directing face, in particular having flow-directing elements for directing the cooking vapors flow, and/or to be provided with a structured feature that is effective in flow-mechanical terms.

The internal side 74 of the closure cap 56 can in particular be shaped in such a manner that the surface of said internal side 74 forms a cladding of the cooking vapors entry installation 41 that is adapted to the flow of the cooking vapors to be expected in the flow region 72.

The closure flap 56 in the second terminal position that unblocks the cooking vapors entry opening 5 is in particular located on that side of the flow region 72 that faces away from the ventilator 43. With a view to the deflection of the cooking vapors flow in the cooking vapors entry installation 41 the closure flap 56 in the second terminal position is in particular located on the external side of the curve.

A reversed pivoting of the closure element 6, that is to say a repositioning of the latter such that the closure flap 56 in the second terminal position is disposed on the internal side of the deflection of the flow region 72, is likewise possible in principle.

As is highlighted in an exemplary manner in FIGS. 20A and 20B, positional guide 75 are in each case disposed in the region of the lateral holding elements 57 of the closure element 6. The positional guides 75 serve for guiding the closure element 6 when removed from the cooking vapors entry installation 41, or when inserted into the latter, respectively. The positional guides 75 are in particular configured as guide structures which have guide webs 76 that are disposed so as to be mutually parallel and which run diagonally across the lateral holding elements 57. In order for the introduction of the closure element 6 to be simplified, the guide webs 76 in the region which in the second terminal position of the closure element 6 faces the cooking vapors entry opening 5 are configured so as to mutually converge.

The guide webs 76 are in particular connected to one another so as to form an encircling guide frame.

A guiding edge 77 of a bearing protrusion 78 is aligned so as to be parallel with the guide webs 76.

The positional guides 75 are in each case disposed on the internal side of the external tiers 79 of the lateral holding elements 57. Said positional guides 75 to this end interact with matching guide elements on the external side of the internal tiers 80 of the lateral holding elements 57.

The positional guides 75 are in particular configured in such a manner that a retrieval of the closure element 6 from the cooking vapors entry installation 41 is possible only when said closure element 6 is located in the second terminal position.

Figure 20C:
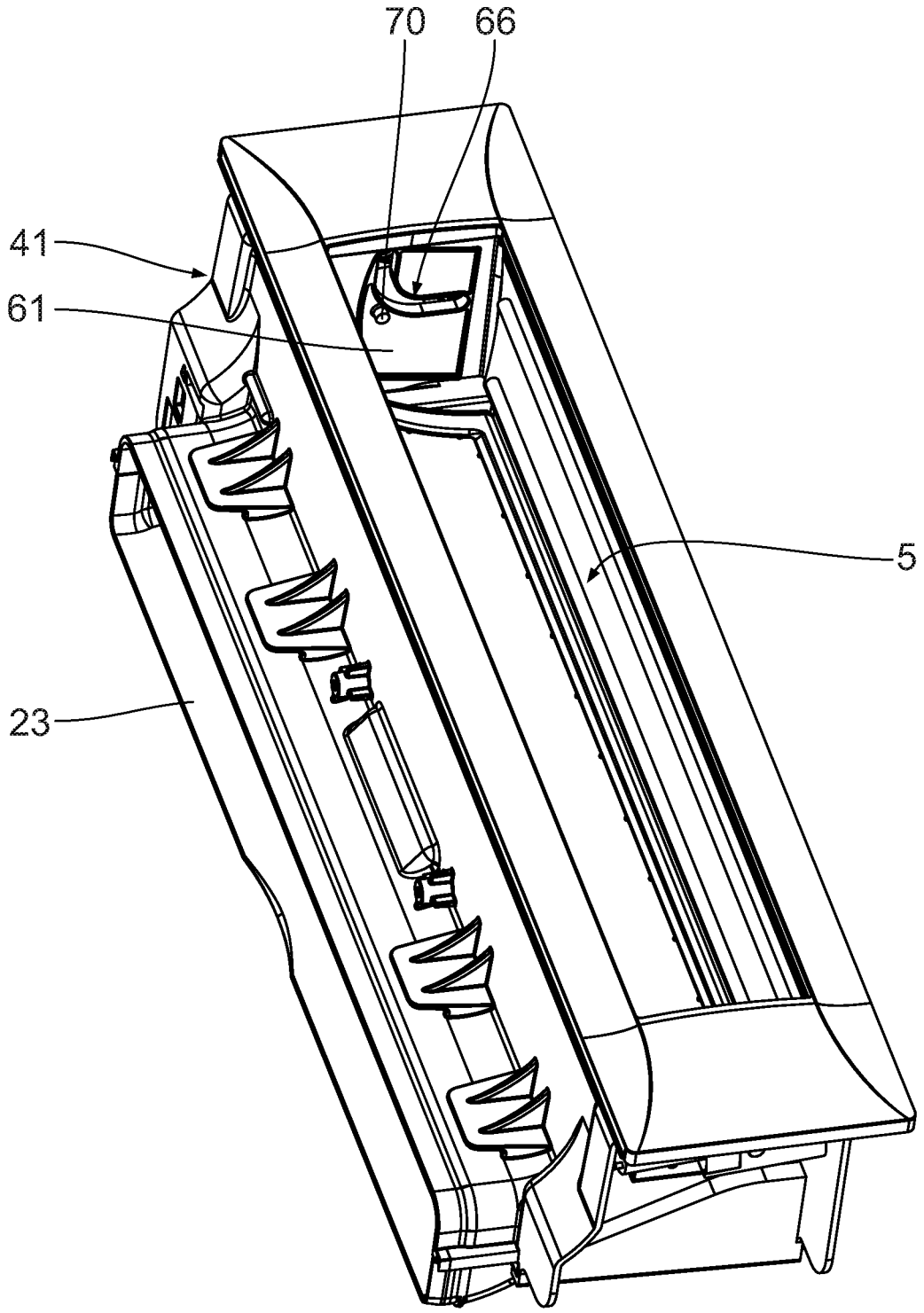
FIG. 20C is a view according to FIG. 20B, wherein the positional guiding has been removed so as to render visible the guide elements for guiding the repositioning of the closure element.

In order for the mutually relative disposal of the guide slide blocks 63, 70 and the guide slots 66, 71 to be highlighted, the lateral delimitation wall 61 of the flow region 72 is illustrated in FIG. 20C.

Further features of the downdraft ventilator 4 will be described hereunder. The suction installation 42 has a control installation 85 which is coupled in a signal-transmitting manner to the activation installation for activating the closure element 6. It can advantageously be in particular provided that the activation installation for activating the closure element 6 is coupled to the control installation 85 for controlling the suction installation 42 in such a manner that the closure element 6 in the activation of the suction installation 42 is automatically repositioned to the second position that unblocks the cooking vapors entry opening 5. Conversely, the control installation 85 for controlling the suction installation 42 can be coupled to the activation installation for activating the closure element 6 in such a manner that an activation of the suction installation 42 is possible only after a repositioning of the closure element 6 to the second position that unblocks the cooking vapors entry opening 5.

It can furthermore be provided that the suction installation after switching-off still continues running for a predefined period. In this case it is advantageously provided that the closure element 6 is repositioned to the first terminal position that closes the cooking vapors entry opening 5 only once this follow-on period has been completed.

The repositioning of the closure element 6 can thus be performed fully automatically so as to depend on the activation of the suction installation 42.

According to one advantageous alternative the downdraft ventilator 4 can have one or a plurality of sensors 82 for detecting the repositioned position of the closure element 6. This sensor is in particular coupled in a signal-transmitting manner to the control installation 85 for controlling the suction installation 42.

A potential positioning of the sensors 82 for detecting the repositioned state of the closure element 6 is schematically illustrated in FIG. 15B.

According to one further advantageous alternative the activation installation for activating the closure element 6 is provided with a jamming guard. One or a plurality of sensors can be provided as means for preventing any jamming. Jamming can also be effectively prevented by way of an electronic circuit. It is in particular possible for an increased resistance in the repositioning of the closure element 6 to be identified by way of an overload on the motor.

As has already been mentioned, the downdraft ventilator 4 can have a removable or retrievable collection tray 28 for collecting liquids. The collection tray 28 is also referred to as the maintenance tray. In terms of further details reference is made to the preceding description.

According to one further alternative the downdraft ventilator 4 has a sensor by means of which it is detectable whether the insert 12, in particular the filter element 13 having the filter 17, is inserted in the cooking vapors entry installation 41. It is in particular detectable whether the filter 17 is correctly inserted, that is to say inserted in the correct position, in the cooking vapors entry installation 41.

By means of the sensors it is possible for the control system of the suction installation 42 to be configured in such a manner that an activation of the ventilator 43 is only possible when the closure element 6 and/or the filter element 13 are/is inserted in the correct position thereof in the cooking vapors entry installation 41. It can in particular be prevented on account thereof that foreign matter is unintentionally drawn into the ventilator 43.

A further sensor for detecting the saturation level of the filter 17 can optionally be provided.

Further details, advantages, and alternatives will be described hereunder in note form.

The closure element 6 is in particular repositionable in such a manner that the cooking vapors suctioned by the suction installation 42 in the second terminal position of the closure element 6 that unblocks the cooking vapors entry opening 5 do not flow directly along said closure element 6.

The inflow region of the cooking vapors entry installation 41, that is to say in particular the region that adjoins the cooking vapors entry opening 5, can be cladded so as to correspond to the expected flow. Said region can in particular also be configured in the manner of a nozzle. The separation of the flow can be reduced on account thereof.

The closure cap 56 in the region of the surface 55 thereof can be configured in such a manner that said closure flap 56 when reaching the first terminal position that closes the cooking vapors entry opening 5 is automatically aligned so as to be centered relative to the cooking vapors entry opening 5.

The closure element 6, in particular the closure flap 56, can also be configured in multiple parts. Individual regions of the closure flap 56 herein can be repositionable in a mutually independent manner. On account thereof, it can be influenced in a flexible manner from which region cooking vapors are suctioned by means of the suction installation 42. For example, it is possible for cooking vapors to be predominantly extracted from a rear region of the hob or hobs 2, or predominantly from a front region of the hob or hobs 2.

The closure flap 56 can be subdivided into two or more part-regions in particular in the longitudinal direction and/or in the transverse direction. The part-regions can in particular be repositionable in a mutually independent manner.

It is also possible for the closure flap 56 to be configured so as to have a subdivision into two or more part-regions which however are only conjointly repositionable. It is in particular possible for the closure flap 56 to be subdivided along the longitudinal direction of said closure flap 56 into two part-regions, in particular two halves, in particular a right and a left half, wherein the right half in the repositioning from the first to the second terminal position is pivoted to the right, and the left half in the repositioning from the first to the second terminal position is pivoted to the left.

The ventilator housing 44 on that side thereof that faces the cooking vapors entry installation 41 in the horizontal direction does not project beyond the maximum horizontal extent of the cooking vapors entry installation 41. This enables the downdraft ventilator 4 to be in principle disposed directly beside a wall and/or peripherally in the kitchen base cabinet 11. The cooking vapors entry installation 41 can have a removable cover plate 81. The cover plate 81 can be placed onto the cooking vapors entry installation 41 in two different positions that are mutually rotated out of position by 180°. This enables the downdraft ventilator 4 to be assembled in the worktop 9 in such a manner that the cooking vapors flow is deflected to the right or to the left in the cooking vapors entry installation 41.

While specific embodiments of the invention have been shown and described in detail to illustrate the application of the principles of the invention, it will be understood that the invention may be embodied otherwise without departing from such principles.

The invention claimed is:

1. A device for extracting cooking vapors, the device comprising:

a cooking vapors entry installation having a cooking vapors entry opening which is closable by at least one closure element; and an activation installation for activating the at least one closure element, wherein the activation installation is configured such that the at least one closure element by the activation installation is repositionable between a first position that closes the cooking vapors entry opening, and a second position that unblocks the cooking vapors entry opening, wherein the at least one closure element in the repositioning between the two positions has at least one rotary movement component and at least one linear movement component, the activation installation comprising a purely rotary drive, the at least one closure element being repositionable via the purely rotary device, wherein the activation installation is configured such that the at least one closure element in the repositioning between the two positions has at least two movement components that are linearly independent.

2. The device as claimed in claim 1, wherein the closure element is repositionable so as to be guided by at least one guide in the form of a slotted link.

3. The device as claimed in claim 1, wherein the at least one closure element in the first position and in the second position lies below an upper boundary of the cooking vapors entry installation.

4. The device as claimed in claim 1, wherein the cooking vapors entry opening is closable in a tight manner by the at least one closure element.

5. The device as claimed in claim 1, wherein the at least one closure element in the second position thereof that releases the cooking vapors entry opening is disposed outside a flow region of the cooking vapors to be extracted in the cooking vapors entry installation.

6. The device as claimed in claim 1, further comprising a suction installation for suctioning cooking vapors through the cooking vapors entry installation, wherein the activation installation for activating the at least one closure element is coupled in a signal-transmitting manner to a control installation for controlling the suction installation.

7. The device as claimed in claim 1, further comprising a retrievable or removable collection tray for collecting liquids.

8. The device as claimed in claim 1, further comprising a suction installation for suctioning cooking vapors through the cooking vapors entry installation, the suction installation having at least one ventilator having a ventilator housing, wherein a spacing between a base of the ventilator housing and an upper periphery of the cooking vapors entry installation in a direction perpendicular to the base of the ventilator housing is at most 30 cm.

9. The device as claimed in claim 1, wherein the device in a region of the cooking vapors entry opening has a width of at most 20 cm.

10. A hob system comprising, wherein the activation installation is configured such that the at least one closure element in the repositioning between the two positions has at least two movement components that are linearly independent:

at least one device comprising a cooking vapors entry installation having a cooking vapors entry opening which is closable by at least one closure element, the at least one device further comprising an activation installation for activating the at least one closure element, wherein the activation installation is configured such that the at least one closure element by the activation installation is repositionable between a first position that closes the cooking vapors entry opening, and a second position that unblocks the cooking vapors entry opening, wherein the at least one closure element in the repositioning between the two positions has at least one rotary movement component and at least one linear movement component, the activation installation comprising a purely rotary drive, the at least one closure element being repositionable via the purely rotary device; and at least one hob.

11. An item of kitchen furniture, comprising:

at least one device comprising a cooking vapors entry installation having a cooking vapors entry opening which is closable by at least one closure element, the at least one device further comprising an activation installation for activating the at least one closure element, wherein the activation installation is configured such that the at least one closure element by the activation installation is repositionable between a first position that closes the cooking vapors entry opening, and a second position that unblocks the cooking vapors entry opening, wherein the at least one closure element in the repositioning between the two positions has at least one rotary movement component and at least one linear movement component, the activation installation comprising a purely rotary drive, the at least one closure element being repositionable via the purely rotary device, wherein the activation installation is configured such that the at least one closure element in the respositioning between the two positions has at least two movement components that are linearly independent.

* * * * *